US010094104B2

(12) United States Patent
Higgins

(10) Patent No.: US 10,094,104 B2
(45) Date of Patent: Oct. 9, 2018

(54) ORTHOGONAL FRAMEWORK FOR MODULAR RESILIENT HOUSES

(71) Applicant: Gregory Higgins, Spokane, WA (US)

(72) Inventor: Gregory Higgins, Spokane, WA (US)

( * ) Notice: Subject to any disclaimer, the term of this patent is extended or adjusted under 35 U.S.C. 154(b) by 0 days.

(21) Appl. No.: 15/479,932

(22) Filed: Apr. 5, 2017

(65) Prior Publication Data

US 2017/0241125 A1 Aug. 24, 2017

Related U.S. Application Data

(63) Continuation-in-part of application No. 15/140,304, filed on Apr. 27, 2016.

(60) Provisional application No. 62/160,186, filed on May 12, 2015.

(51) Int. Cl.

| | |
|---|---|
| ***E04H 12/00*** | (2006.01) |
| ***E04B 1/24*** | (2006.01) |
| ***E04H 9/00*** | (2006.01) |
| ***E04H 15/62*** | (2006.01) |

(52) U.S. Cl.

CPC ..... *E04B 1/2403* (2013.01); *E04B 1/24* (2013.01); *E04H 9/00* (2013.01); *E04H 15/62* (2013.01); *E04B 2001/246* (2013.01); *E04B 2001/2406* (2013.01); *E04B 2001/2418* (2013.01); *E04B 2001/2454* (2013.01); *E04B 2001/2463* (2013.01); *E04B 2001/2481* (2013.01)

(58) Field of Classification Search

CPC ..... E04B 1/1903; E04B 1/2403; E04B 2001/2418; E04B 2001/193

USPC ..... 52/653.2, 655.1, 648.1

See application file for complete search history.

(56) References Cited

U.S. PATENT DOCUMENTS

| | | | |
|---|---|---|---|
| 1,867,226 | A | 7/1932 | Martin |
| 2,106,084 | A | 1/1938 | Coddington |
| 3,513,610 | A | 5/1970 | Devonport |
| 3,837,754 | A | 9/1974 | Malcik |
| 3,877,579 | A | 4/1975 | Weider |
| 3,960,458 | A | 6/1976 | Sato |
| 4,235,559 | A | 11/1980 | Rooklyn |
| 5,289,665 | A | 3/1994 | Higgins |
| 5,410,847 | A | 5/1995 | Okawa |
| 6,032,431 | A | 3/2000 | Sugiyama |
| 6,739,099 | B2 | 5/2004 | Takeuchi |
| 8,468,775 | B2 | 6/2013 | Vaughn |
| 8,863,438 | B1 | 10/2014 | Seitz |
| 2004/0244330 | A1 | 12/2004 | Takeuchi |
| 2007/0209314 | A1 | 9/2007 | Vaughn |

*Primary Examiner* — Basil S Katcheves

(74) *Attorney, Agent, or Firm* — Fitzpatrick Cella Harper & Scinto

(57) ABSTRACT

An orthogonal framework for the fabrication of modular buildings includes a plurality of hub members formed to fit in the ends of vertical hollow post members including base hubs for securing the lower end of a hollow post to a foundation and/or base beams or shear panels, terminal hubs for securing the top ends of a post upper beam members and/or the upper ends of shear panels, and intermediate tubes for securing the ends of two vertically aligned posts together and/or to support beams for the building. The hubs are hollow and have press nuts mounted on their inner surfaces to allow the terminals to be bolted to the posts, beams and shear panels in a large variety of beam and post combinations to form modular buildings in various configurations.

11 Claims, 32 Drawing Sheets

ORTHOGONAL FRAMEWORK FOR MODULAR RESILIENT HOUSES

RELATED APPLICATIONS

This application is a continuation in part of U.S. patent application Ser. No. 15/140,304 filed on Apr. 27, 2016 and claims the benefit of U.S. Provisional Application No. 62/160,186 filed May 12, 2015, the disclosures of which are incorporated herein by Reference.

BACKGROUND OF THE INVENTION

Field of the Invention

The present invention represents an improvement in the original ORTHOGONAL FRAMEWORK FOR MODULAR BUILDING SYSTEMS which is the subject of U.S. Pat. No. 5,289,665. Such frameworks allow for the simple manual, quick and inexpensive assembly of buildings using a few standardized components with simple manually operated tools by unskilled labor.

Description of Related Art

U.S. Pat. No. 5,289,665 discloses a framework arrangement using a bracket to shaft or post coupling assembly that permits the faces of horizontal beams to align with the faces of square tubular vertical posts and comprises a minimum of interchangeable parts which can be used to form a variety of orthogonal building structures. Part of the coupling assembly includes post sections having key holes formed therein which allow U-shaped brackets to be attached to the post sections by keys formed on the brackets. The brackets then allow the beams to be bolted to them and thus to the posts. The system shown in U.S. Pat. No. 7,637,076 is similar to that of U.S. Pat. No. 5,289,665, but is more complex. It uses square hollow posts which receive column inserts therein, with the inserts having nuts mounted on their inner surfaces aligned with bolt holes in the insert and in the post to allow the ends of I beams to be bolted to the posts. This structure is heavier and more complex than the framework of the '665 patent and more complex to fabricate.

A multitude of other space enclosure systems exist which also allow assembly of interconnecting parts to form a limited number of specific building types, shapes and sizes. Prior art systems include post and beam frameworks which are complete interconnecting systems but which require the integration of many assorted panel configurations of varying shapes, adding complexity to both the manufacturing task as well as in-situ assembly.

A multitude of connector assemblies have previously been proposed but none permits separate parallel beams to attach to posts, as in the present invention, such that beams can be added in any 90° degree or 180° degree direction for the support of both horizontal (floor, roof) and vertical (walls) infill means, even after the initial or starter framework is assembled.

Efficient manufacturing of space enclosure components is achieved when variations in dimension and shape are minimized. This optimization of size and shape is especially advantageous if the uniformity of the components does not limit the resulting size and shape of the desired end, i.e., a complete building unique to the intended use.

BRIEF SUMMARY OF THE INVENTION

The present invention includes and improves upon the goal of minimizing parts but includes significant improvements which include:

1) Maximizing the interchangeability of components;

2) Minimizing "handedness" of components;

3) Maximizing the ability to assemble many types of structures of varying size and configurations;

4) Maximizing the ability of system components to be close-packed for inter-modal delivery, even to remote regions.

The overarching goal of the present invention is to allow a structural enclosure to be erected by any able bodied person, using one simple tool, resulting in strong, safe structures that are exceptionally resilient.

In accordance with an aspect of the invention, a novel and improved framework component system is provided which permits vertical posts to be coupled together, to a foundation, to foundation beams, intermediate beams and roof beams using connecting hubs and L-shaped demountable beam connection brackets, as opposed to the U-shaped brackets of the '665 patent, in order to allow variation in the number and shapes of connections that can be made. When assembled, as described hereafter, the floor and wall loads are supported by beams independent of adjacent infill structural means such as walls, roof, and floor panels. The framework of the invention is intended to be made of steel with various bolting arrangements.

The present invention also pertains to rapid assembly of posts and beams for the purpose of supporting various types of infill and shear panels to permit attachment of a watertight building shell. Shear panels are structural elements formed as braced panels to counter the effects of lateral load on a structure, most commonly wind and seismic loads. In addition, the posts and beams used in the present invention provide convenient vertical and horizontal routes or passages for utility subsystems such as wiring and piping.

OBJECTS OF THE INVENTION

A primary object of the invention is to achieve a rapid building enclosure which can be easily erected and made weathertight before subsystems such as electrical, plumbing and ventilation parts are installed; this is made possible primarily by the dual beam arrangement joined to a suitably prepared hollow column thereby establishing an easily accessible means of vertical and horizontal distribution of utility subsystems.

Another object of the invention is to economize manufacturing costs as compared to prior systems by providing a framework of a lesser minimum number of parts of uniform size and easily secured connecting means which can be used to construct a variety of building sizes and types.

Another object of the invention is to provide a structural framework composed of lightweight parts which can be erected straight and true by unskilled persons, a few common hand tools and generally available standard hardware, primarily simple nut and bolt fasteners.

Another object of the invention is generally that the parts of the framework be of such size and weight that two persons can assemble these parts without the aid of special lifting equipment such as cranes.

Another object of the invention is to provide a post or column to beam connector assembly which permits a varying number of horizontal beams to be employed in support of either floor or wall assemblies of varying materials, including wood, metal, glass, ceramic, and plastic.

Another object of the invention is to provide a building framework of high strength, and especially resistant to earthquake type forces, using easily installed braced frameworks made of steel sections.

The above and other objects features and advantage of the present invention will be apparent to those skilled in the art in the following detailed description of an embodiment thereof wherein:

DETAILED DESCRIPTION OF THE PREFERRED EMBODIMENTS

Figure 1A:
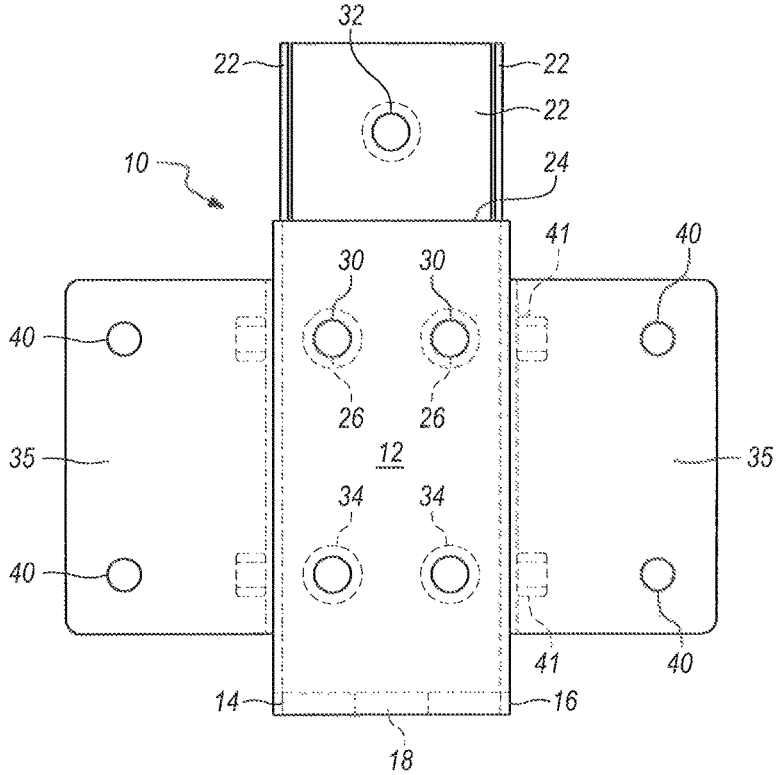
FIG. 1A is a top exploded view of a base hub, associated L-brackets, and bolts for the novel post and beam structure of the invention.
Figure 1B:
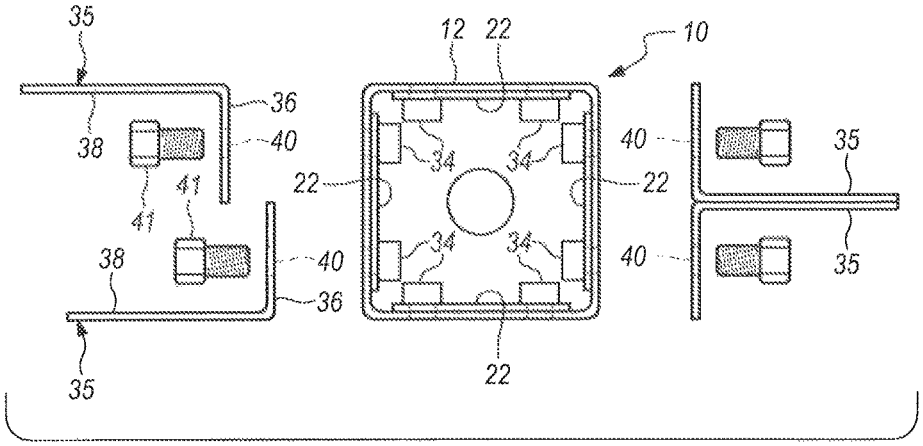
FIG. 1B is an elevational view of the hub and hub elements and brackets mounted on the hub.

Referring now to the drawings and initially to FIGS. 1A and 1B, a base hub 10 is illustrated which forms the interface between the foundation of a building to be erected and the orthogonal framework of the invention. Base hub 10 includes a tubular member 12 which is preferably square in cross section as seen in FIG. 1A having a bottom plate 14 secured therein at its lower end 16. The plate 16 has a bottom hole 18 (shown in dotted lines) formed therein which will receive a foundation bolt mounted in the foundation (typically concrete) and secured in the hub by a nut (not shown).

A plurality of mounting plates 22 are secured to the interior walls of the tube 12, by welding or the like, and they extend above the top end 24 of tube 12. Plates 22 have a plurality of bolt holes 26 formed therein corresponding to and aligned with bolt holes 30 formed in the tube 12. In addition the plates have other bolt holes 32 formed therein in the part of the plates which extend above the upper end 24 of sleeve or tube 12. These extensions, or mounting plates, are formed to fit into the lower end of a hollow post 69 (not shown in FIG. 1B, see FIG. 6A) that is of the same cross-sectional shape as the tube 12, so that the post's lower end can be installed over the plates 22 with its lower end seated on the top edge of tube 12.

Press nuts 34 are secured to the inner faces of the plates 22, in alignment with the bolt holes 26, 30 and 32 in any convenient manner e.g. by welding or press fitting into preformed complementary recesses in the plates. As a result the bottom end of the posts can be firmly secured to the hub through the bolt holes 32.

In accordance with another feature of the invention the framework includes a plurality of L-shaped brackets 35 which are used to secure beams, as described hereinafter, to the hub. These brackets have short legs 36 whose length is about half the width of the adjacent side of sleeve 12 and longer legs 38. The brackets can be mounted on the sleeve 12 with their long legs spaced from one another, as shown at the left in FIG. 1B, or adjacent each other as shown at the right in FIG. 1B. The short leg has bolt holes 40 formed therein spaced to align with the bolt holes 26, 30 in the sleeve 12 and the plates 22 so that they can be secured to the hub by bolts 41.

The long legs of brackets 35 also have bolt holes 40 formed therein for securing beams or other structural members to the hub.

The L-shaped brackets 35 are used in this invention in the place of the original U-shaped brackets of U.S. Pat. No. 5,289,665. This results in many more possible beam-to-hub arrangements. The present system also uses stronger bolted connections devised through the use of press-nuts in the hub. In addition the hub is shortened to match the depth of the C-section beams described hereinafter, typically 8 inches. By extending the length of the L-bracket, the tab shown in FIG. 6 of U.S. Pat. No. 5,289,665 was eliminated. This simplifies beam fabrication and increases beam strength.

Figure 2A:
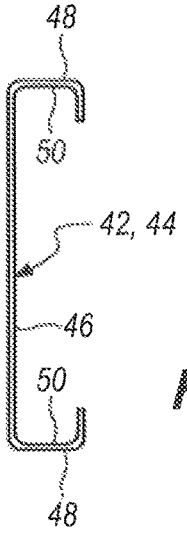
FIG. 2A is an end view of the generally C-shaped beams used in the invention.
Figure 2B:
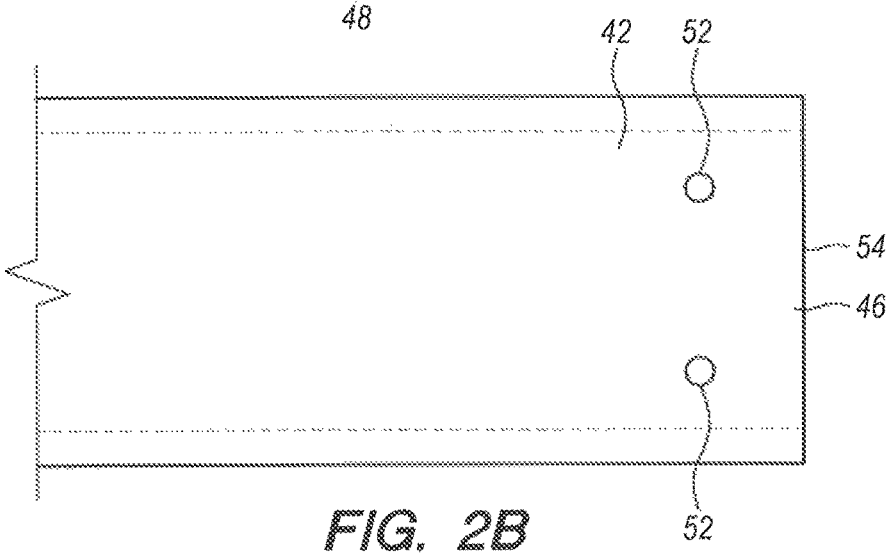
FIGS. 2B and 2C are respectively partial elevational views of the ends of a typical end beam and a tie beam, of the shape shown in FIG. 1A, used in the invention showing the different bolt hole locations used on these beams.
Figure 2C:
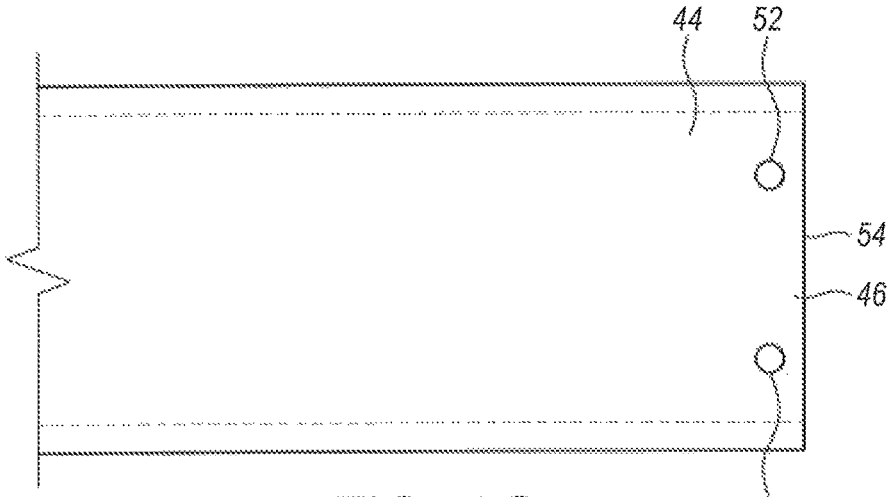

FIGS. 2A-2C show the C-Section beams 42, 44 to be attached to brackets 35. The present invention uses two slightly different 90 degree corner interfacing beam types having butt-type ends. The beams have the same cross section as shown in FIG. 2A, and include a main section or web 46, and two flanges 48 forming facing U-shaped channels 50 on one side of the beam. Beam 42 shown in FIG. 2B is referred to herein as an end beam and has a pair of bolt holes 52 formed therein spaced, in one embodiment, about two and a quarter inches from its butt end 54 to align with the bolt holes 40 in the long legs of the brackets 35 so the brackets and beams can be conveniently bolted together by a plurality of nuts and bolts with manually operated tools.

Beam 44 shown in FIG. 2C is referred to herein as a tie beam and is identical to the end beam except its bolt holes 52 are closer to the beam end 54 (about three quarters of an inch in one embodiment) and is slightly shorter in length in order to form a joint at a corner post for an exterior wall assembly as shown in FIGS. 3 and 7A-7D as described hereinafter.

Figure 3A:
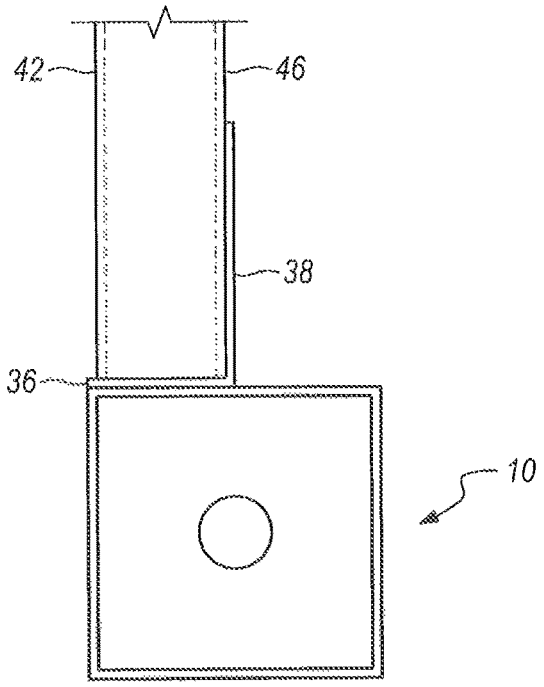
FIGS. 3A-3X are a series of schematic plan views showing the various beam combination connections that can be made to the hub of FIG. 1.
Figure 3B:
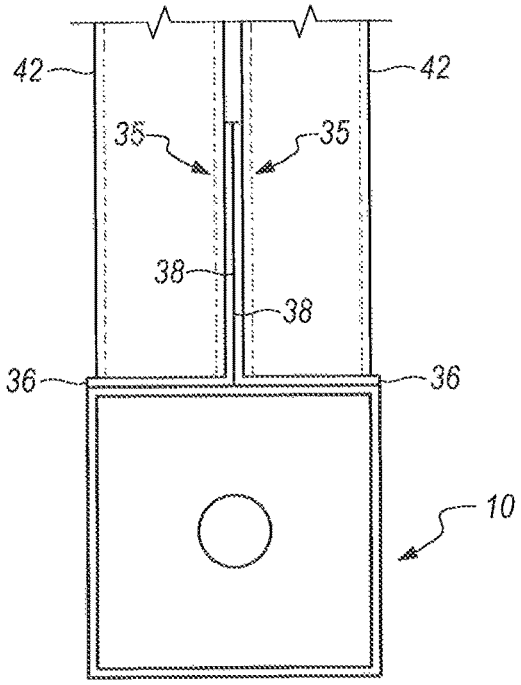
Figure 3C:
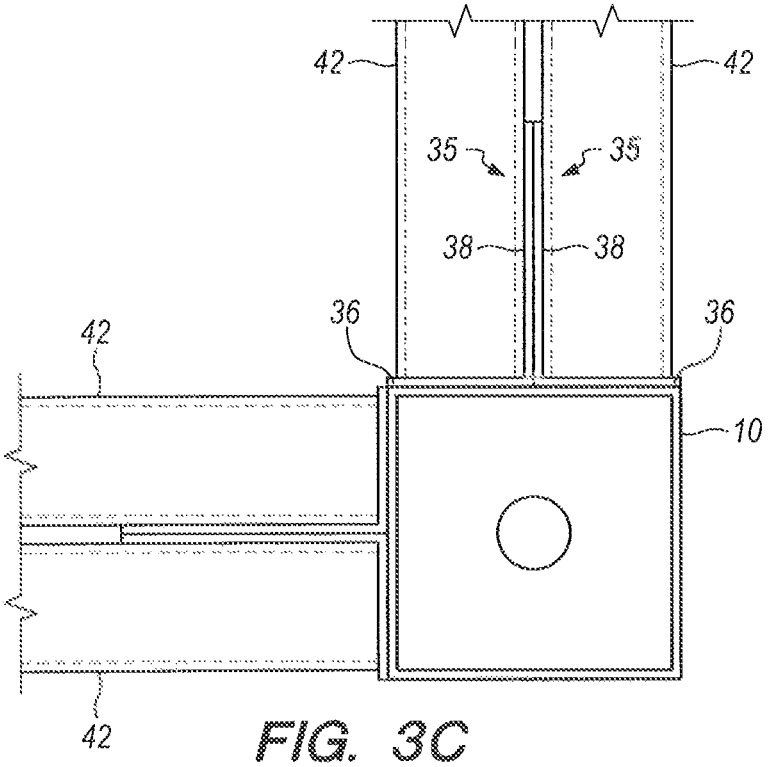
Figure 3D:
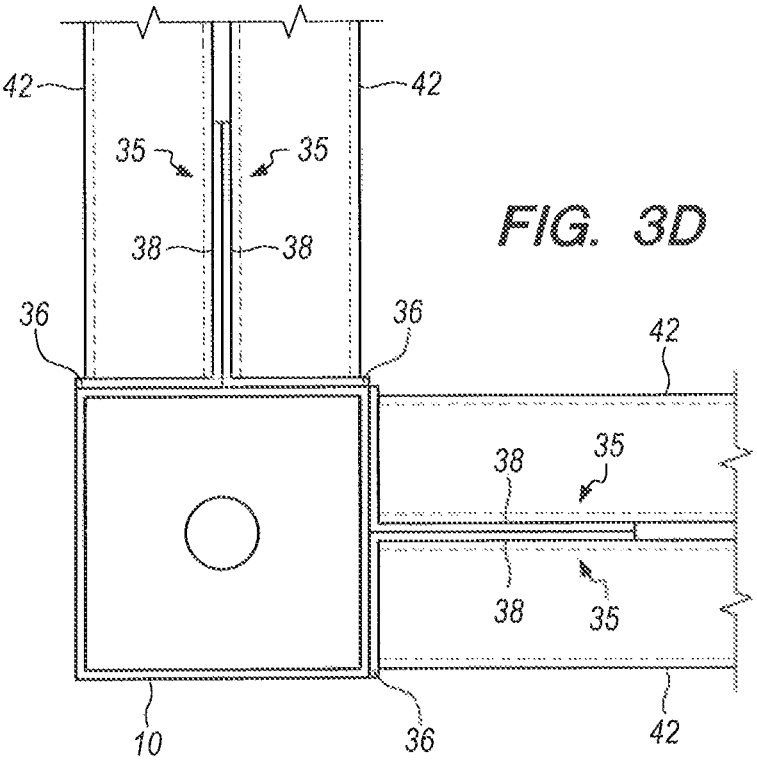
Figure 3E:
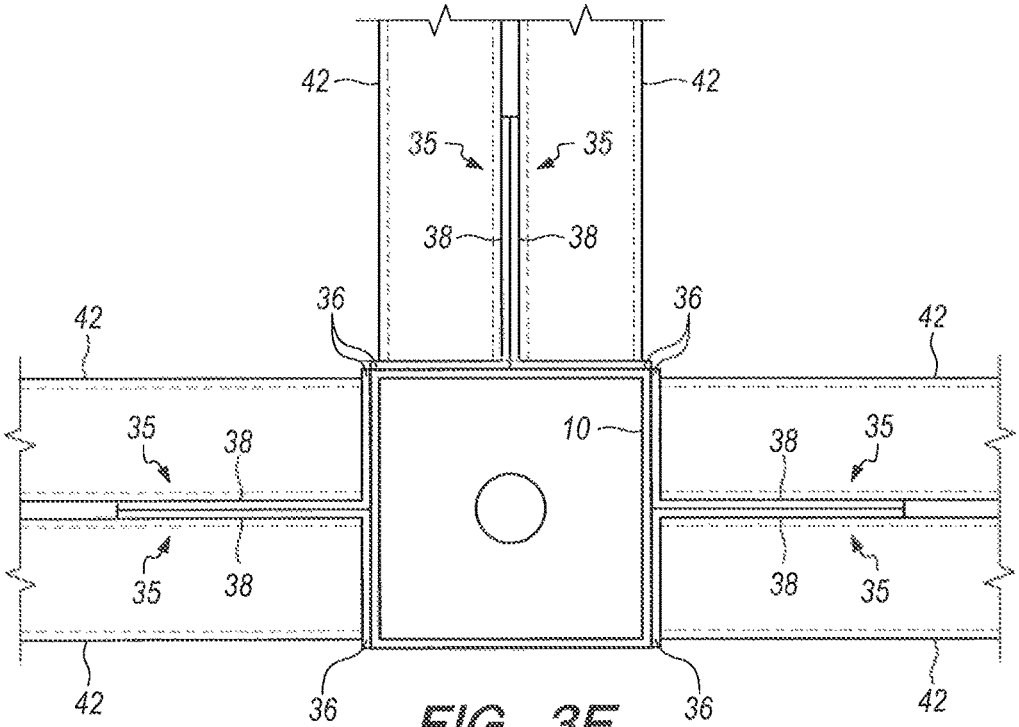
Figure 3F:
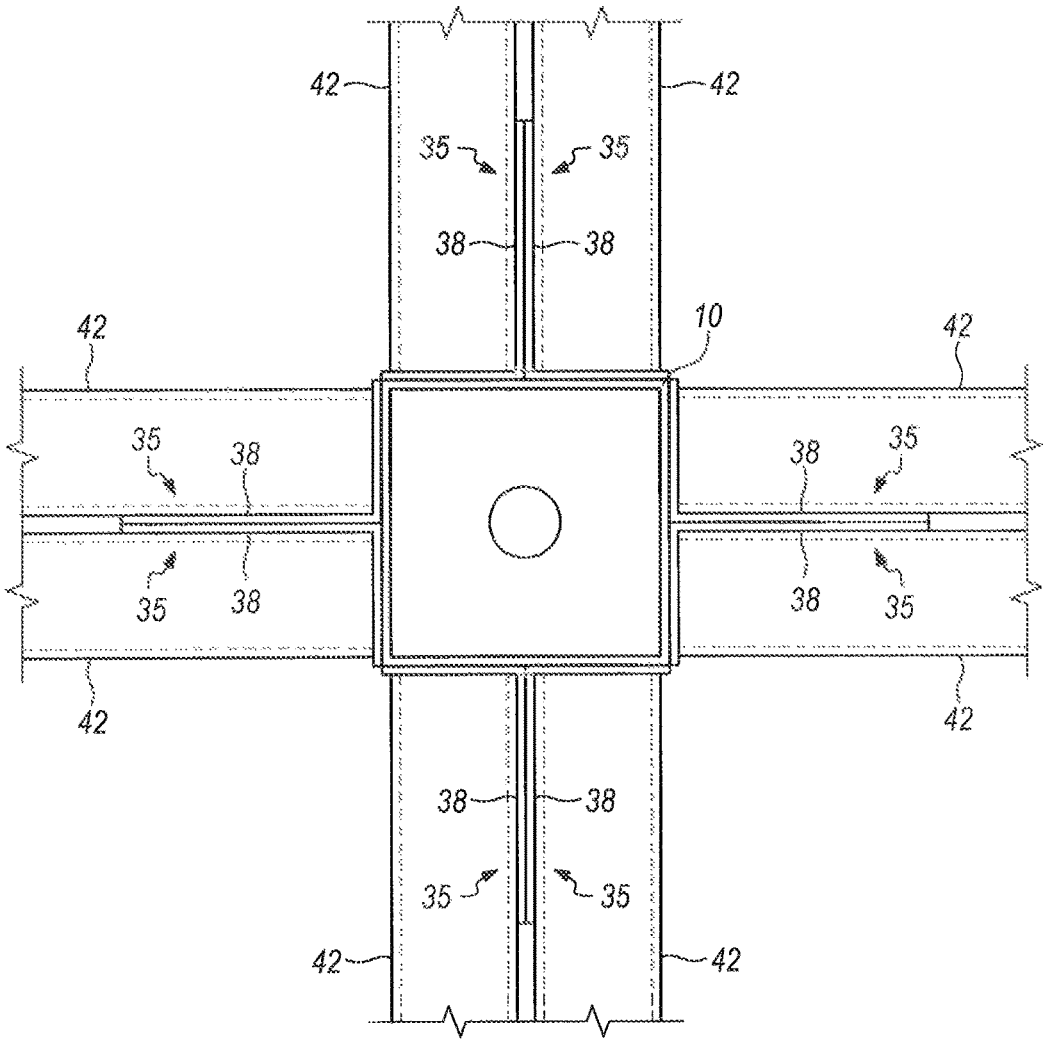
Figure 3G:
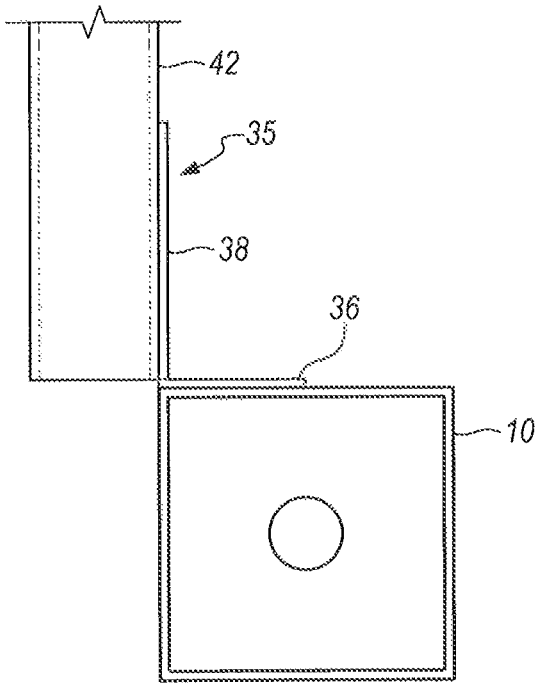
Figure 3H:
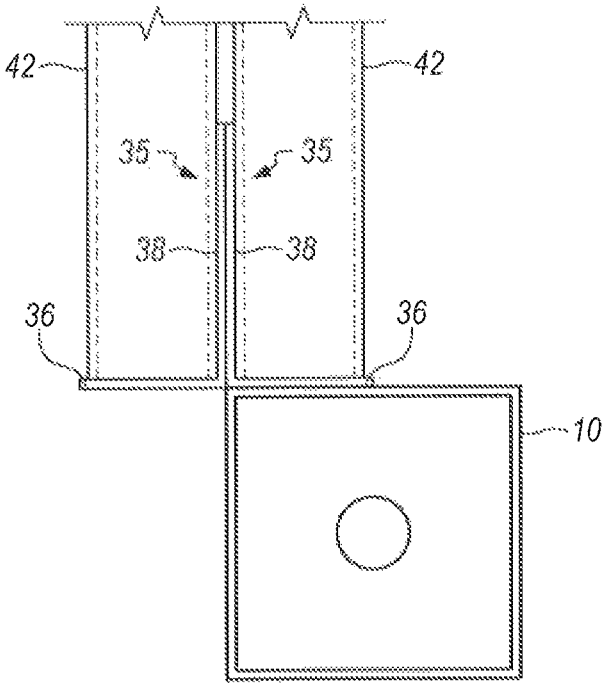
Figure 31:
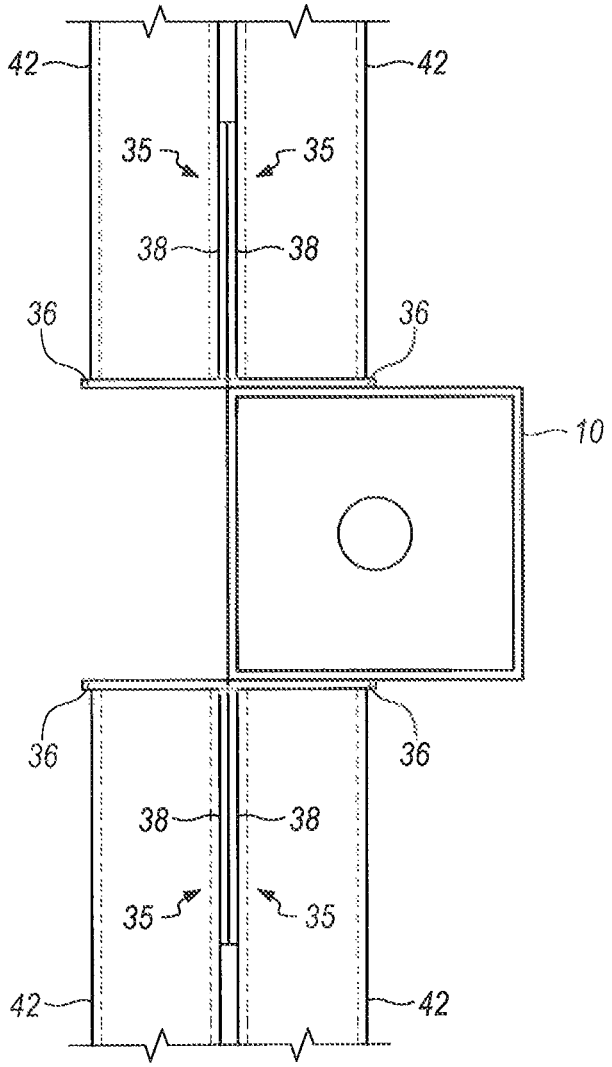
Figure 3J:
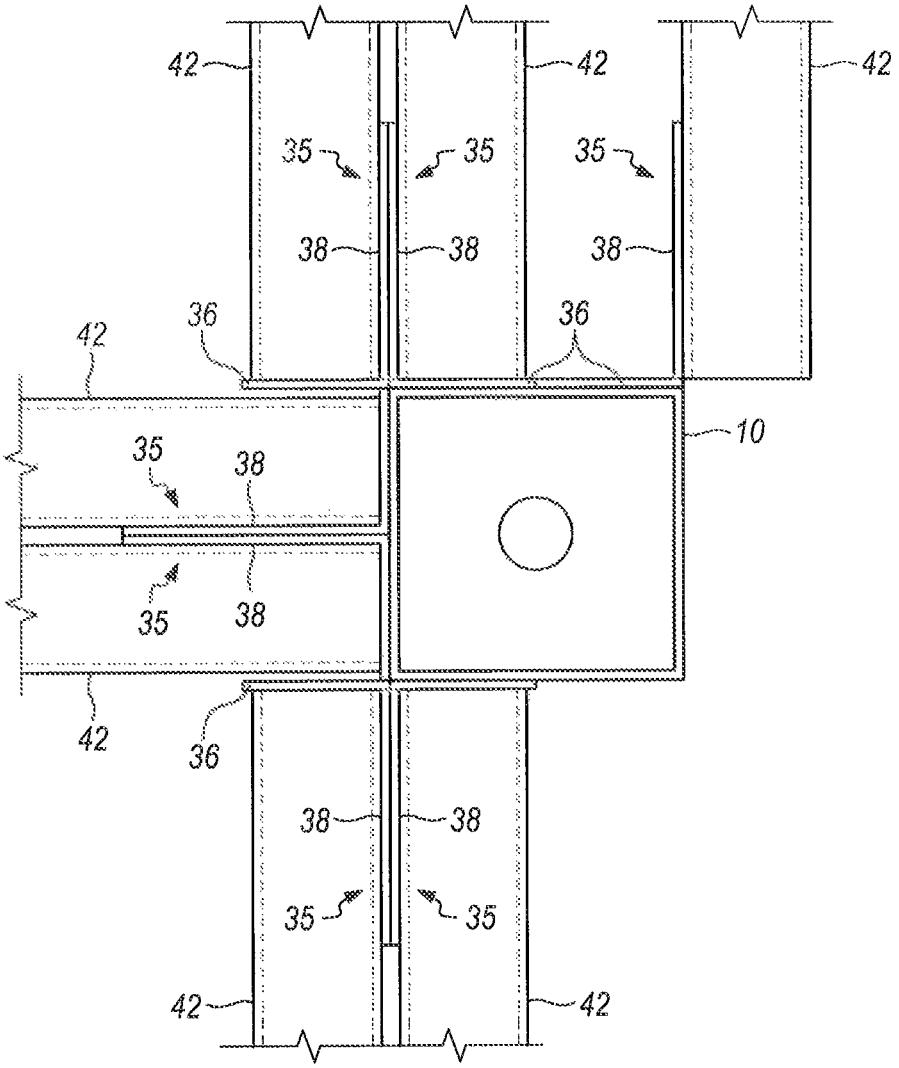
Figure 3K:
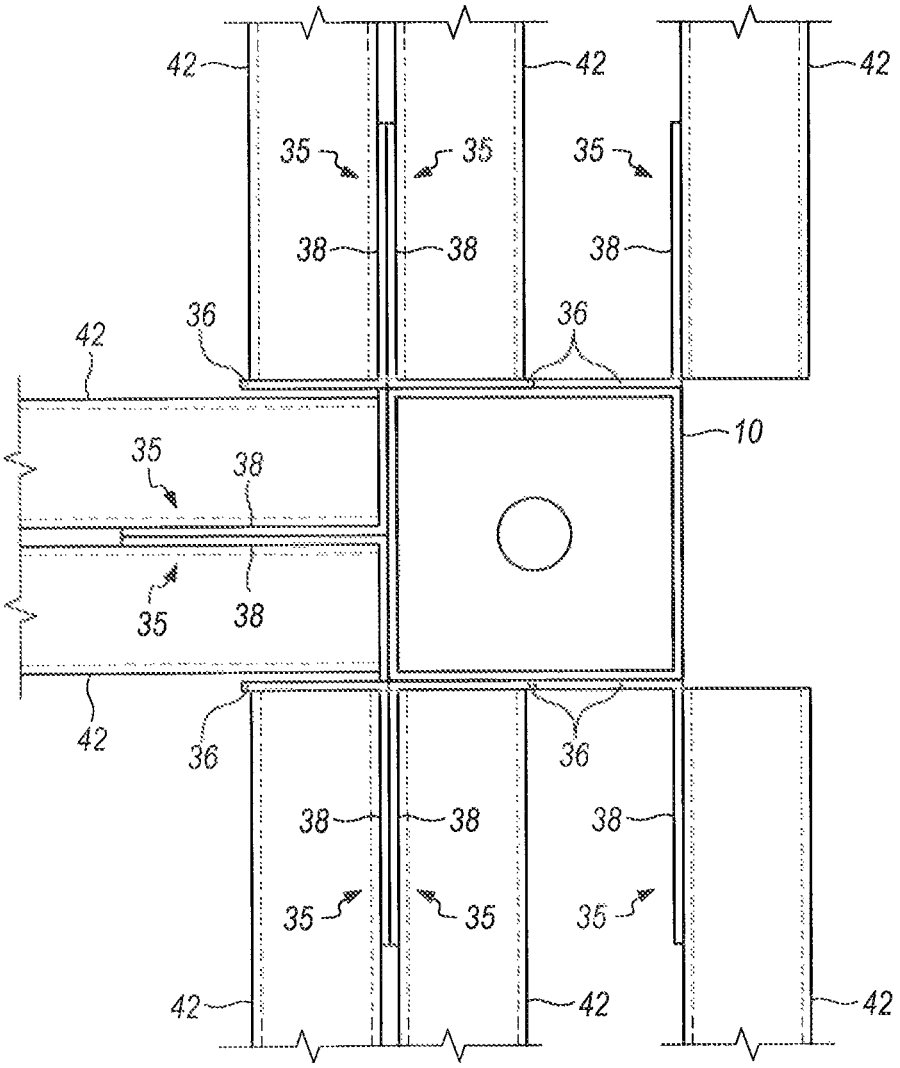
Figure 3L:
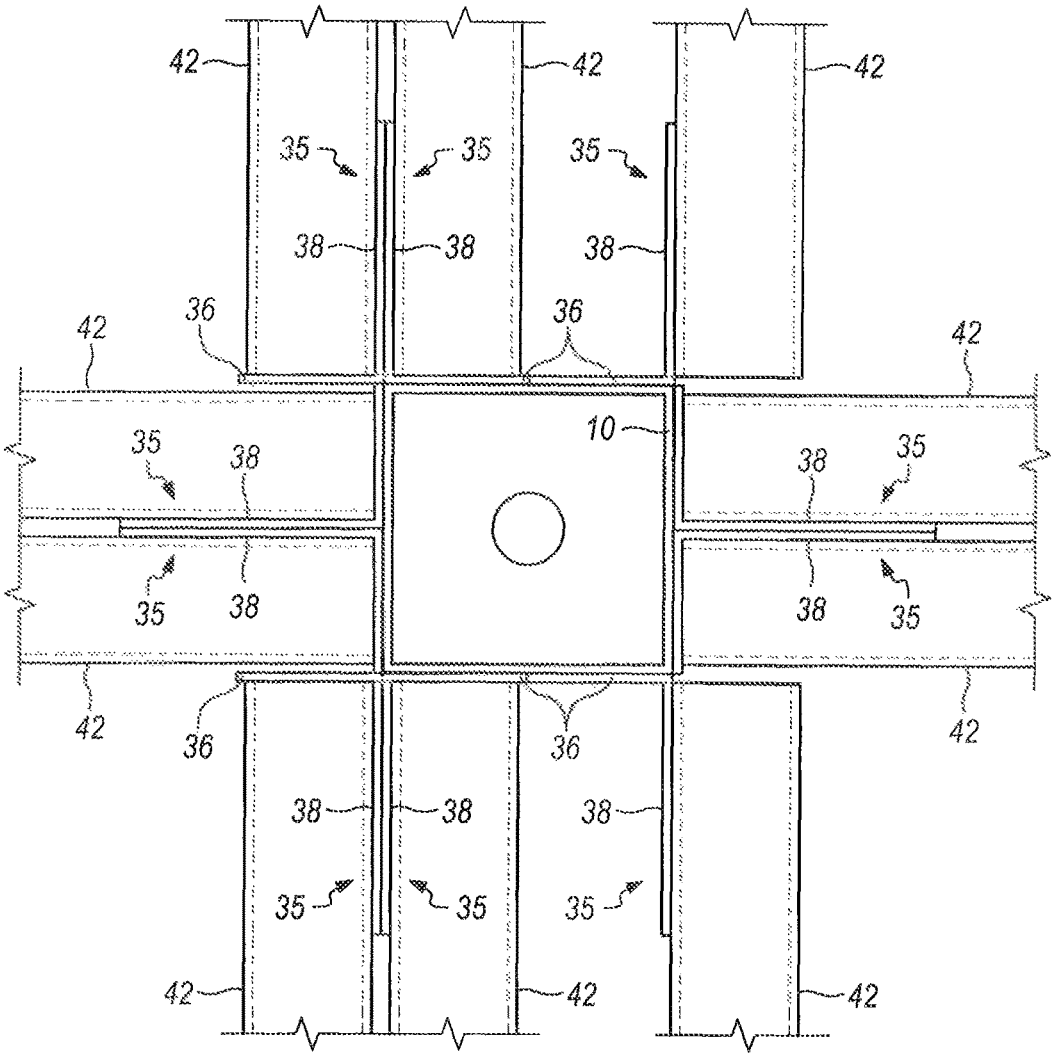
Figure 3M:
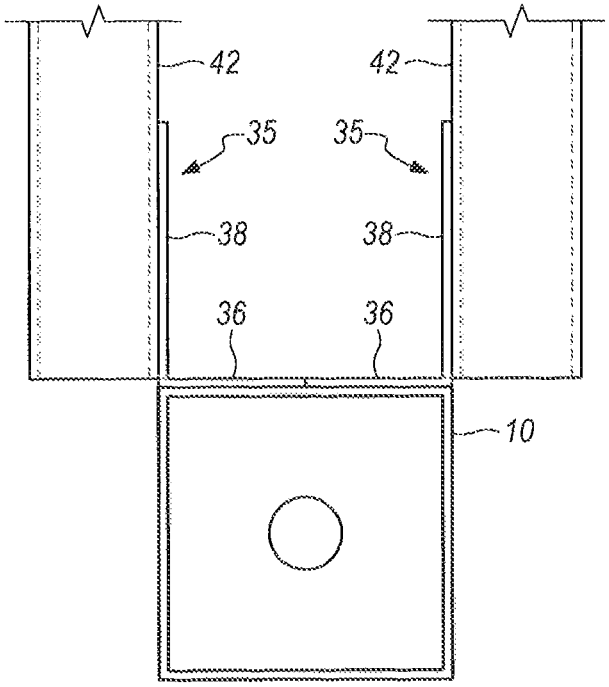
Figure 3N:
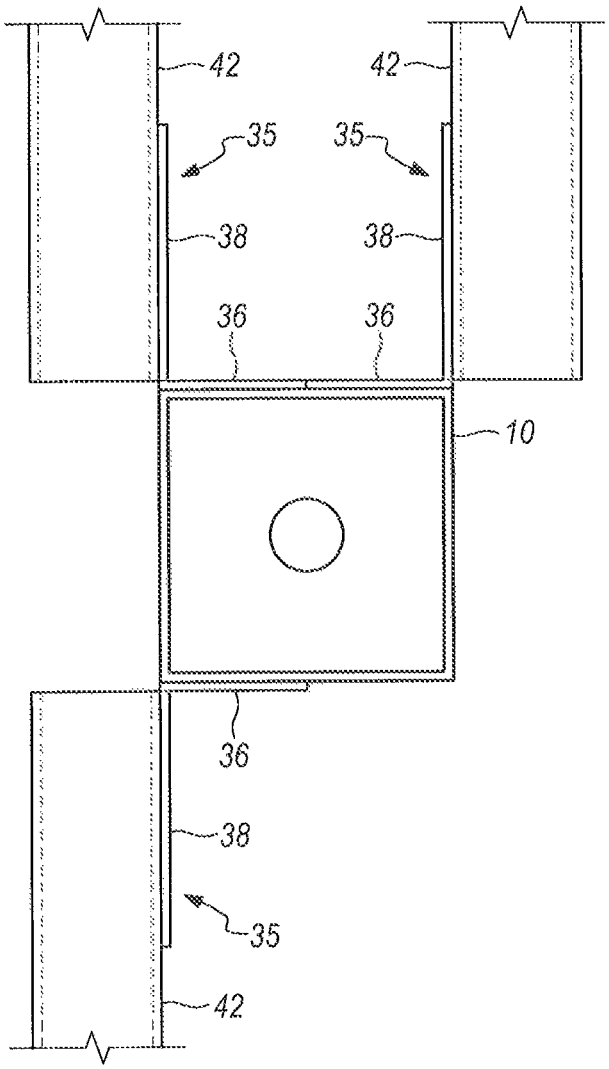
Figure 30:
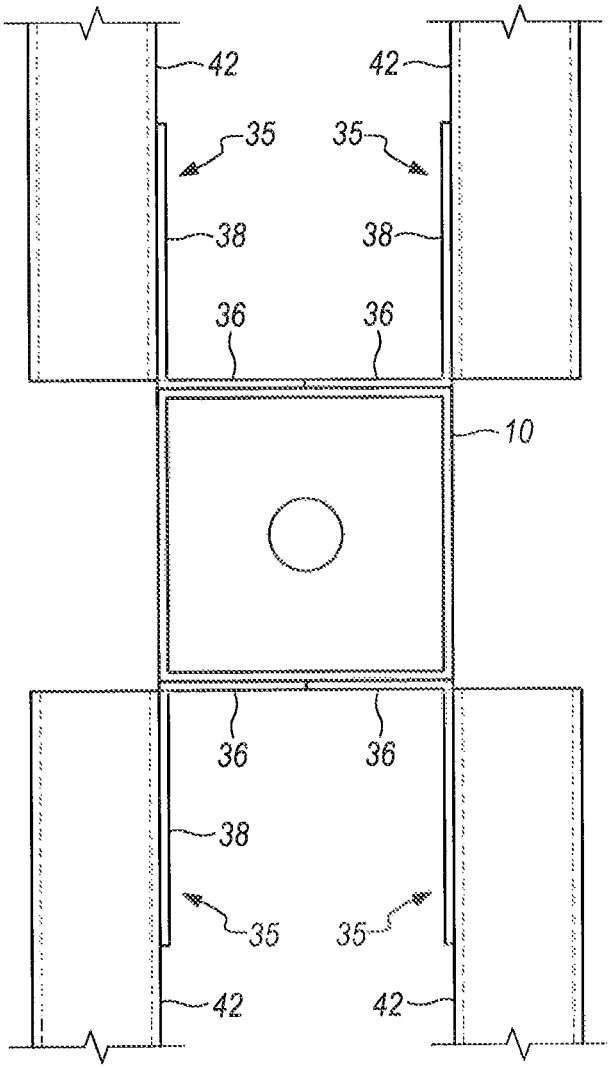
Figure 3P:
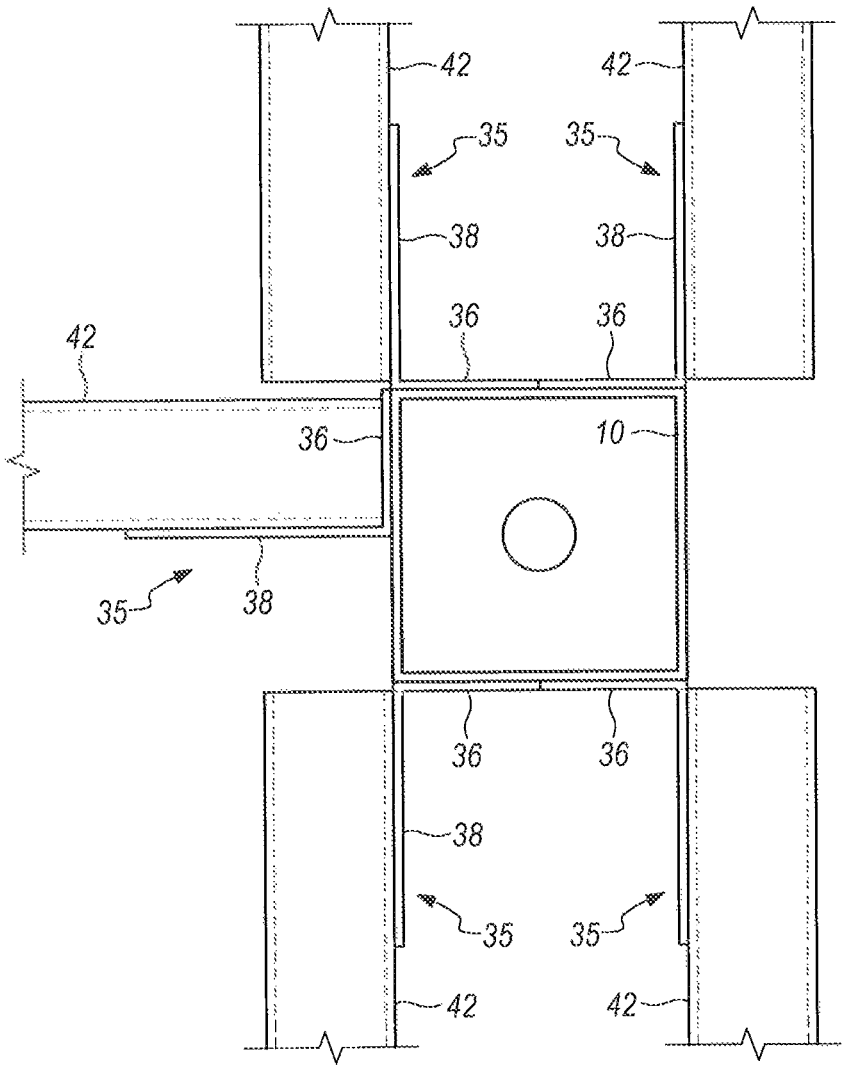
Figure 3Q:
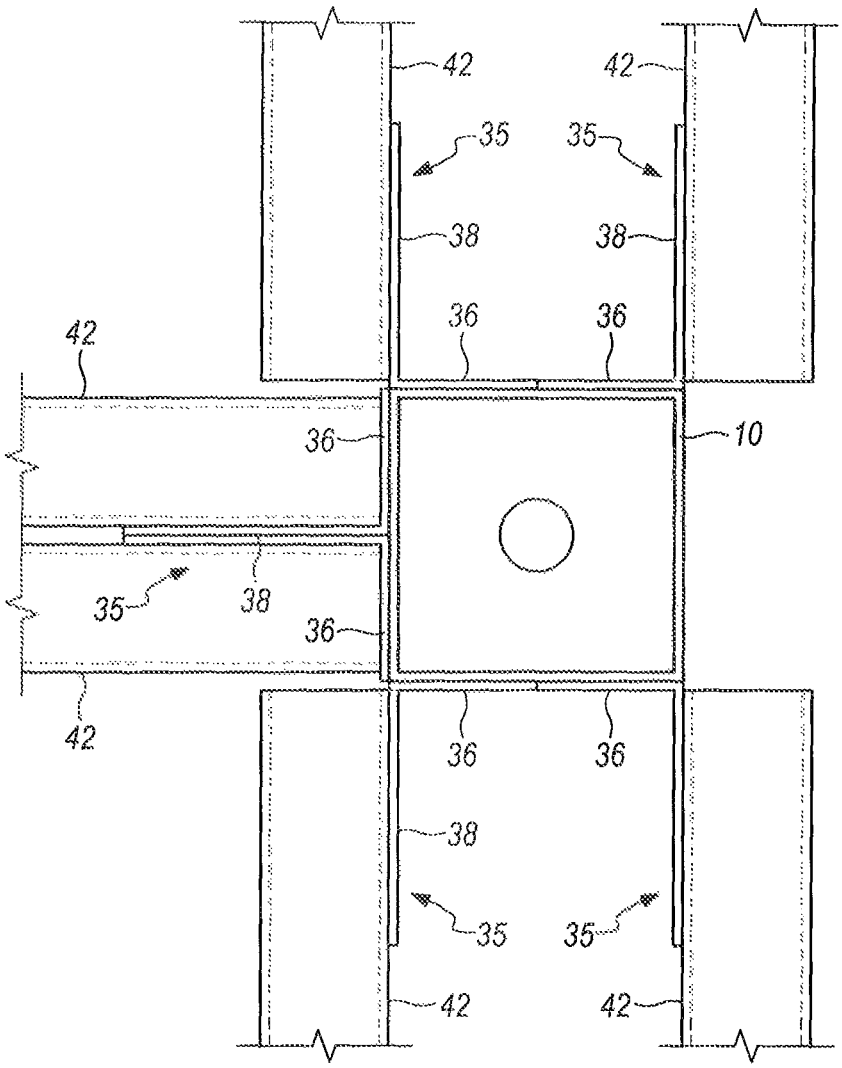
Figure 3R:
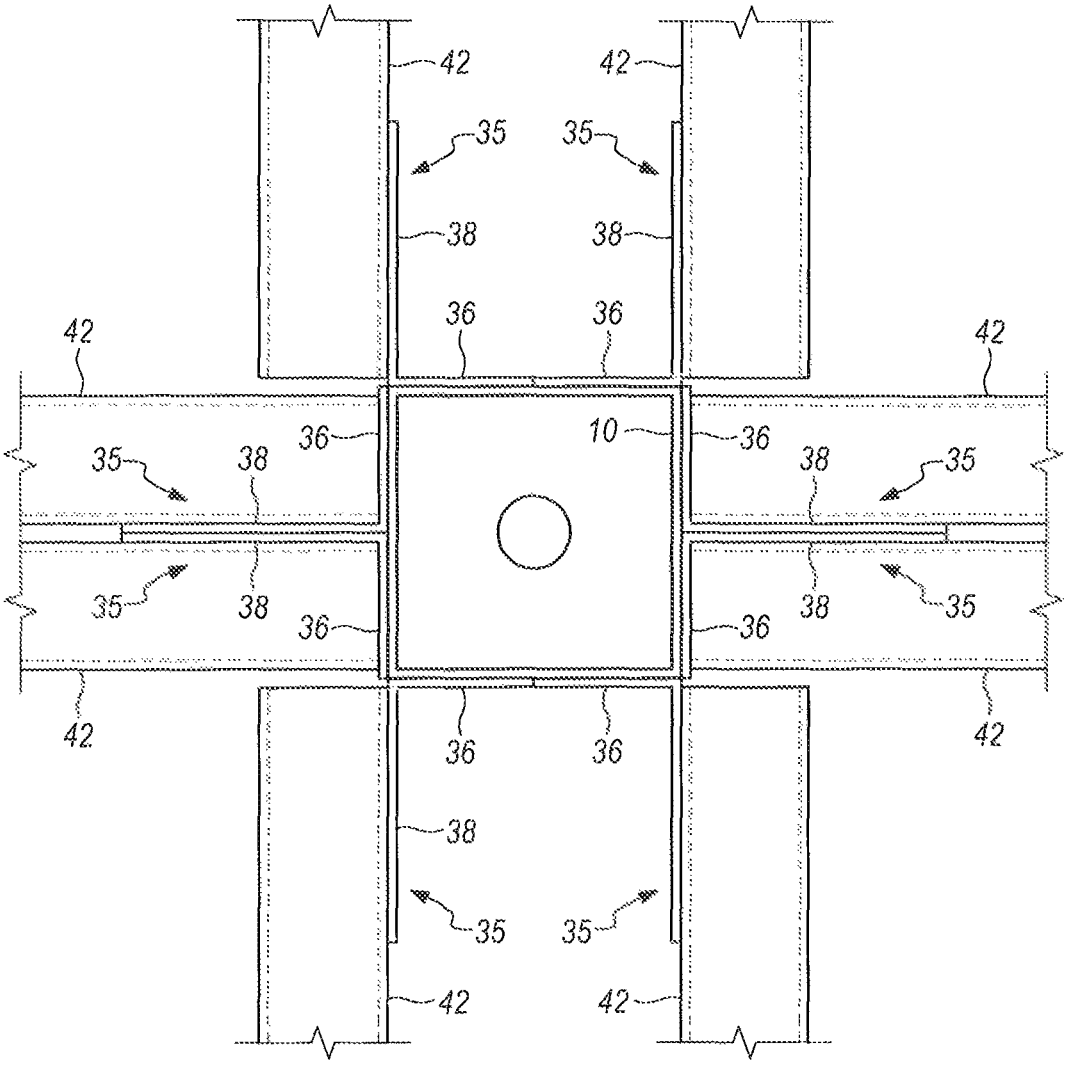
Figure 3S:
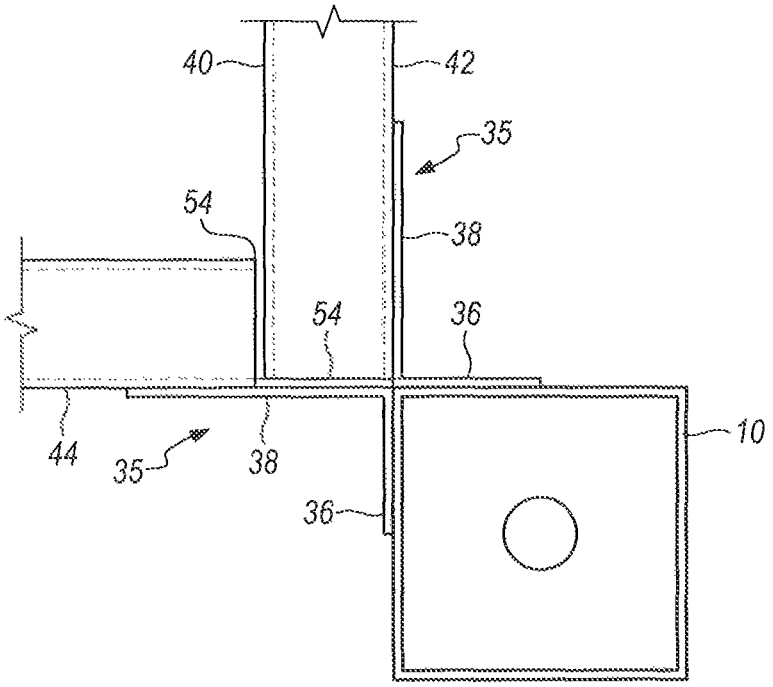
Figure 3T:
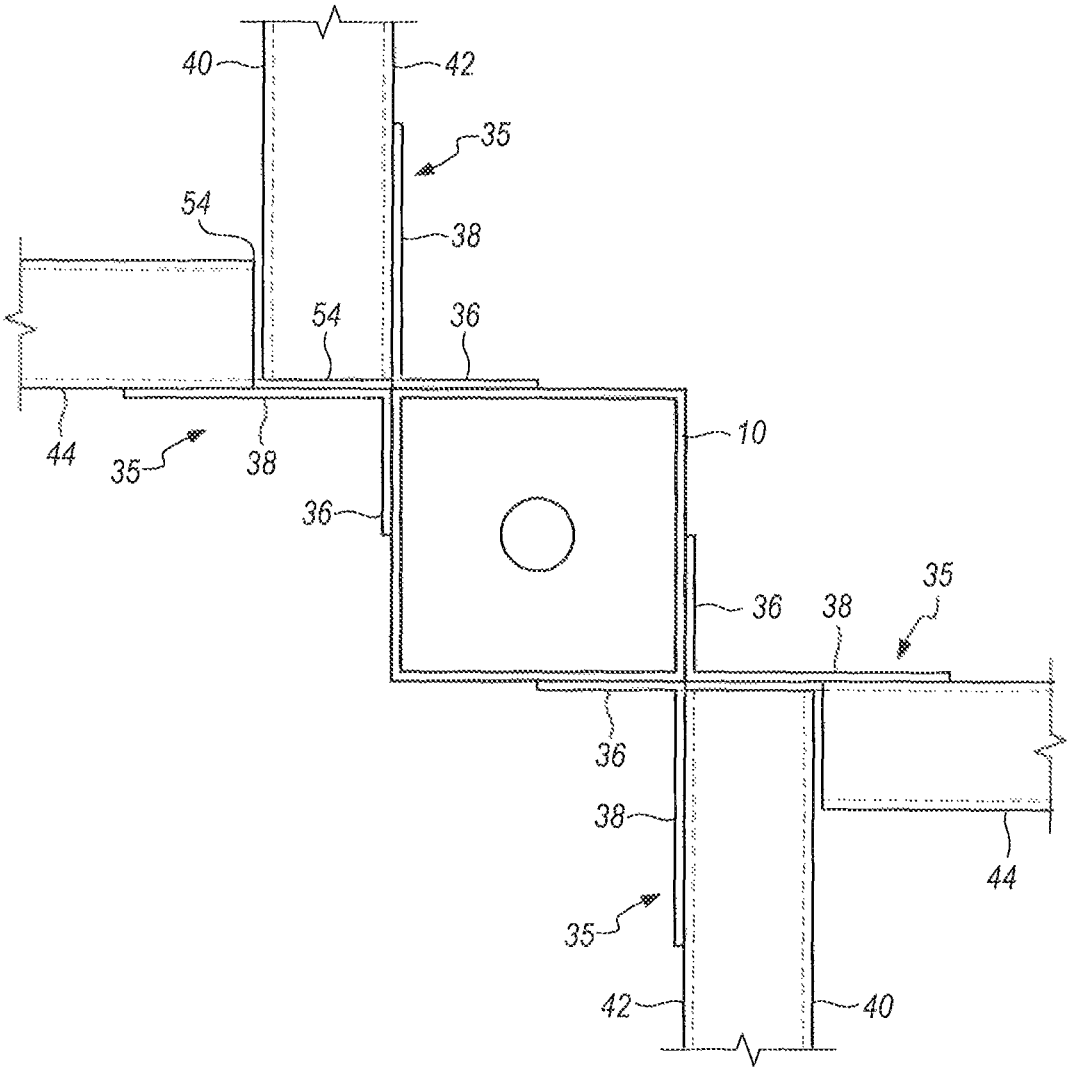
Figure 3U:
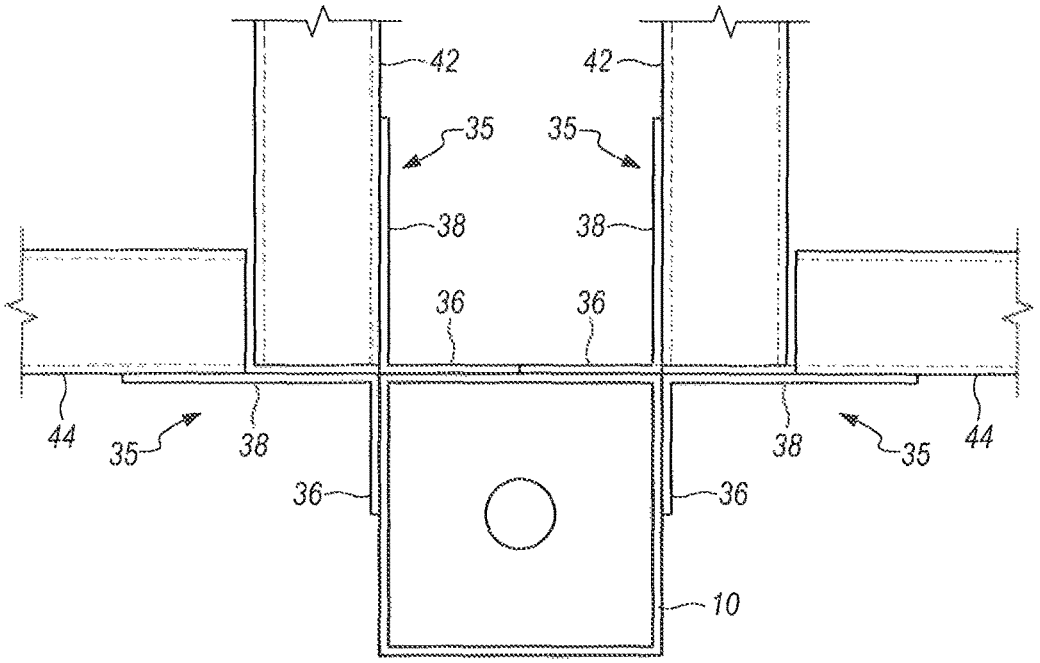
Figure 3V:
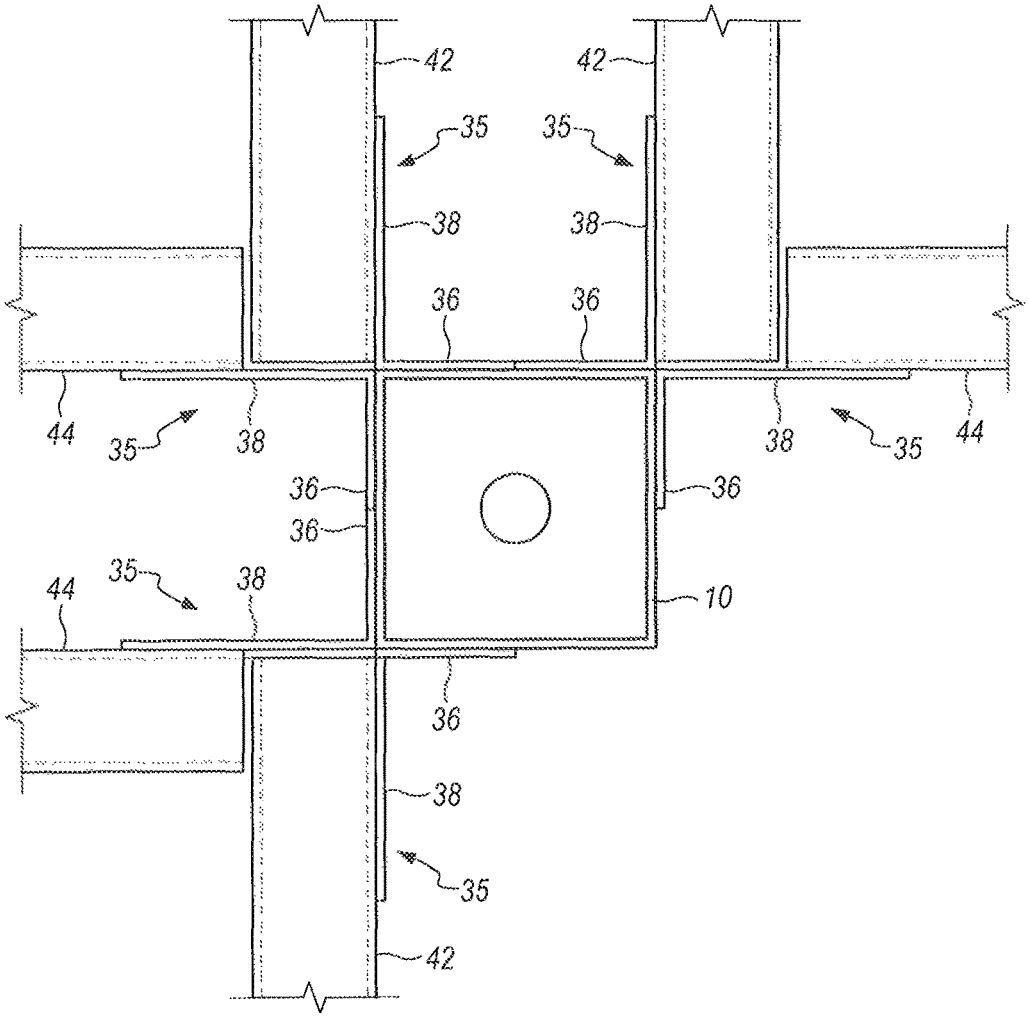
Figure 3W:
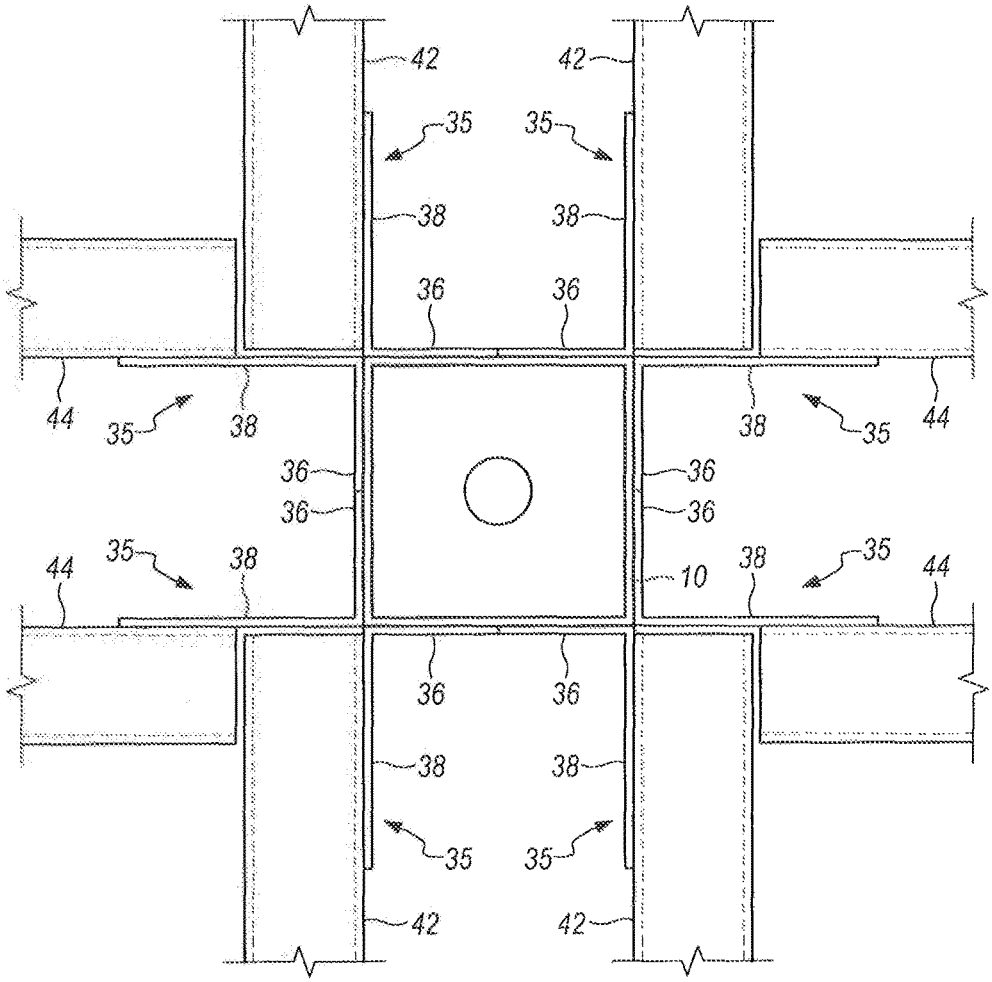
Figure 3X:
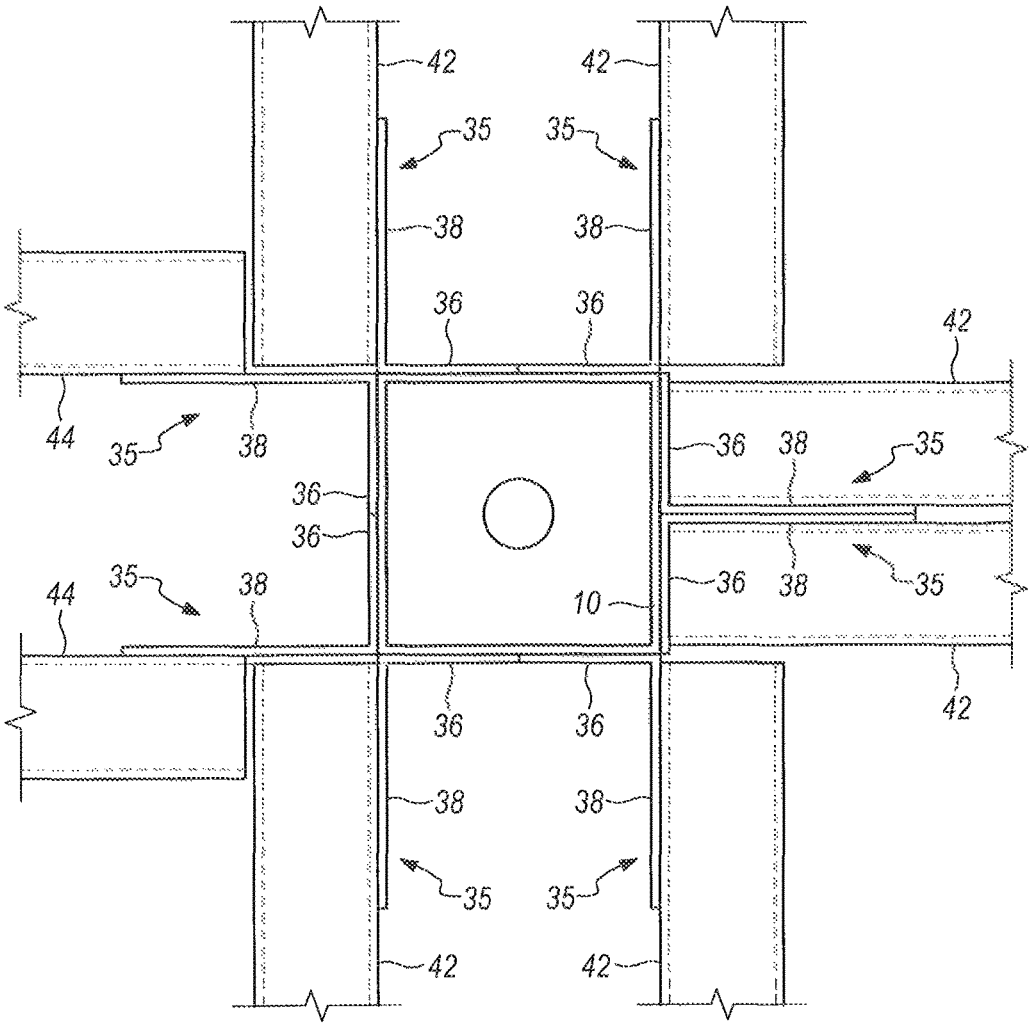

FIGS. 3A-3X illustrate an array of plan view schematic diagrams of a hub as described above connected to beams in 24 different combinations of beams each using four components: hubs, L-brackets, and one or more end beams, and/or tie beams. This illustrates the exceptional versatility inherent to the system of the invention. (The previously described bolt holes, bolts and nuts are not shown in these illustrations for simplicity but their location would be evident in view of FIGS. 1 and 2).

FIG. 3A illustrates a hub connection using hub 10, one L-bracket 35 mounted with its long leg 38 generally aligned with the center of the adjacent side of the hub and a single end beam 42 mounted on the bracket's leg 38 with its central web 46 against the bracket leg 36.

FIG. 3B shows a hub connection similar to FIG. 3A except two brackets 35 are bolted to the hub with their long legs 38 contacting each other and two end beams respectively bolted to the long legs. As would be understood by those skilled in the art the connecting bolts would penetrate both bracket legs and both beam webs so only one set of four nuts and bolts are required to make this bracket/beam connection.

FIG. 3C shows a hub connection similar to FIG. 3B except it includes an identical two beam 42 connections on a second side of the hub 10.

FIG. 3D shows a two end beam connection similar to FIG. 3C except the second set of end beam connections is made on a different side of the hub.

FIG. 3E shows three two end beam connections like that of FIG. 3A on three respective sides of the hub.

FIG. 3F shows two end beam connections on all four sides of a rectangular hub.

FIG. 3G illustrates the same components as in FIG. 3A but with the bracket 35 mounted with its long leg aligned with a side of the hub 10 so the beam 42 does not abut the hub as in FIG. 3A but is to the side of the hub.

FIG. 3H shows a hub connection similar to that of FIG. 3G except an additional end beam 42 is mounted on the long leg 38 of bracket 35.

FIG. 3I shows a two end beam connection like that of FIG. 3H on two sides of the hub 10.

FIG. 3J shows a hub connection similar to that of FIG. 3I except that on one side of the hub (the left side as seen in FIG. 3J) two additional beams are connected through the use of two brackets 35, as in FIG. 3B, and a connection like that of FIG. 3G is made in the upper right hand corner of the hub.

FIG. 3K shows a connection arrangement similar to FIG. 3J except an additional beam 42 is mounted in the lower right hand corner of the hub 10 with a connection like that of FIG. 3G.

FIG. 3L shows a connection arrangement similar to that of FIG. 3K except in this case the fourth side of the hub 10 is connected to a further pair of end beams in the manner described above for FIG. 3B.

FIG. 3M is a connection arrangement with two end beams 42 respectively attached to two L-brackets 35 whose long legs 38 align with side of the hub with the end beam webs 46 engaged against the long legs 38.

FIG. 3N shows a connection similar to that of FIG. 3M except in this case a third bracket 35 is mounted on an opposite side of the hub from the brackets in FIG. 3M and a third end beam 42 is mounted on the third bracket's long leg 38.

FIG. 3O shows a connection system similar to that of FIG. 3N except with a fourth bracket 35 mounted on the hub with a fourth end beam attached to its long leg 38.

FIG. 3P shows a connection system similar to that of FIG. 3O except an additional end beam 42 is mounted on one side of the hub as shown in FIG. 3A.

FIG. 3Q shows a hub connection arrangement like FIG. 3P except it includes an additional end beam 42 connected to the bracket on the left side of the hub in the manner disclosed above for FIG. 3B instead of the single end beam shown in FIG. 3P.

FIG. 3R shows a hub connection similar to that of FIG. 3Q except it includes an additional two end beam connection of the FIG. 3B type on the opposite side of the hub from the one shown in FIG. 3Q.

FIG. 3S shows a corner connection using an end beam 42 and a tie beam 44. In this case two L-brackets 35 are mounted on two sides of the hub at right angles to each other. The end beam is mounted as shown in FIG. 3A to one bracket's leg 38 and its end 54 abuts the leg 38 of the other bracket. The end 54 of the tie beam then abuts the flanges 40 of the end beam. The bolt holes 52 of the tie beam, because they are closer to the end 54 of the tie beam as described above, align with the bolt holes 40 in the adjacent bracket leg 38 so the tie beam can be connected to the hub.

FIG. 3T shows a hub connection similar to that of FIG. 3S except it includes an additional corner connection using a tie beam and an end beam on the diagonally opposite corner of the hub from the single connection of FIG. 3S.

FIG. 3U shows a hub connection similar to FIG. 3S with a second end beam/tie beam corner on one of the corners of the hub adjacent the connection shown in FIG. 3S.

FIG. 3V shows a hub connection similar to FIG. 3U wherein three of the four corners of the square hub illustrated include a tie beam/end beam connection like that of FIG. 3S.

FIG. 3W shows a hub connection similar to that of FIG. 3V but showing the use of the tie beam/end beam connection of FIG. 3S on all four corners of the hub.

FIG. 3X shows the hub connection of FIG. 3W with an additional pair of end beams mounted to one side of the hub according to the connection of FIG. 3B. Similar connections for additional beams could be provided for the other sides too.

These various figures demonstrate that the use of non-handed L-shaped brackets and C-beams allow the beams to be positioned in numerous ways to secure the C-beams at the hubs outboard from the face of the posts or centered on the posts to provide a great variety of modular structural configurations. This system represents a vast improvement of flexibility as compared to I-beam structures.

Figure 4:
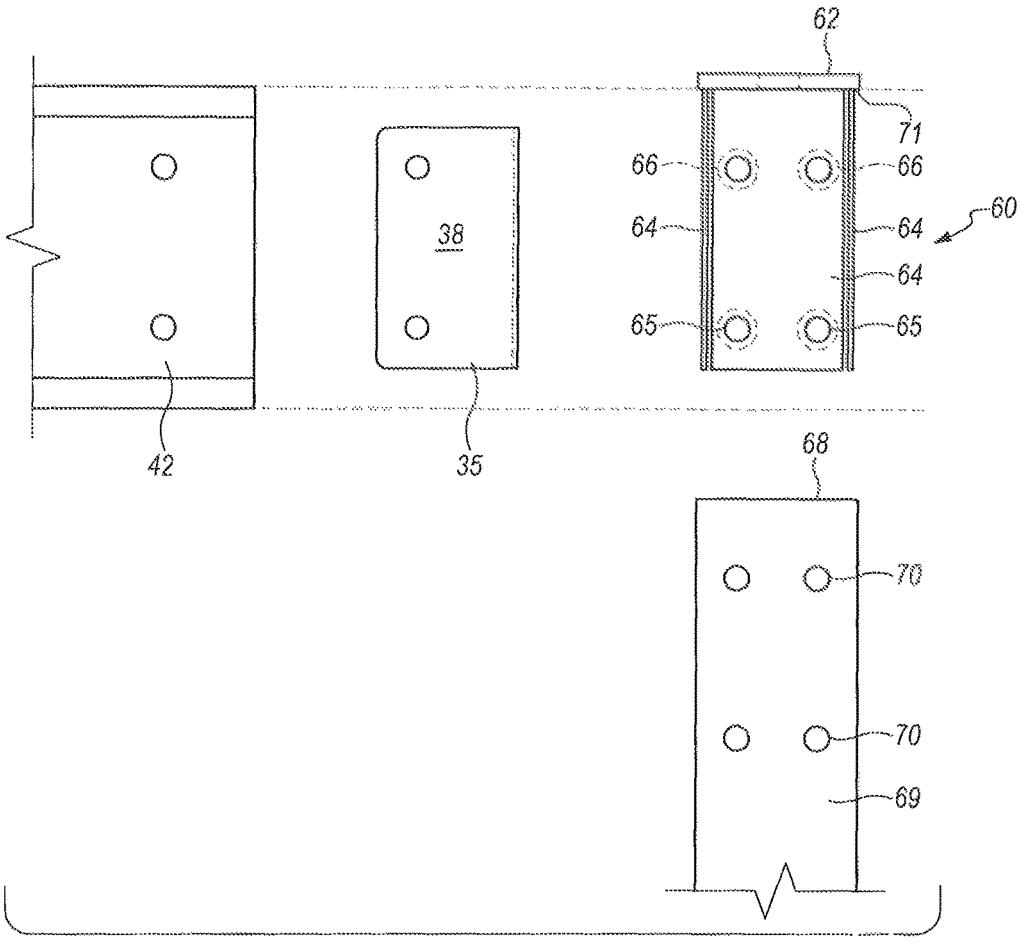
FIG. 4 is an exploded elevational view showing the connection of a top terminal hub to a post, L bracket and typical end beam.

FIG. 4 illustrates a top, or terminal hub 60 used at the top of the vertical posts 69 used in this invention to connect beams or other structural components to the top of the posts. In this case the terminal hub 60 is formed simply of a base plate 62 and a plurality of mounting plates 64 (in this case 4 in a square pattern) welded to plate 62. The plates 64 have a plurality of bolt holes 65 formed therein (four in this illustration) which are aligned with press nuts or welded nuts 66 on their inner surfaces. The plates are dimensioned to fit snuggly within the top 68 of a post 69, the sides of which also contain bolt holes 70 that align with bolt holes 65 when the terminal hub 60 is installed in the post. The edges of plate 62 extend beyond the plates 64 to provide a lip 71 that engages the end 68 of the post 69. This arrangement allows L-shaped brackets 35, as described above, to be bolted to the post and/or tie beams 42 or 44 to be attached to the upper end of the post in any of the above described configurations.

Figure 5A:
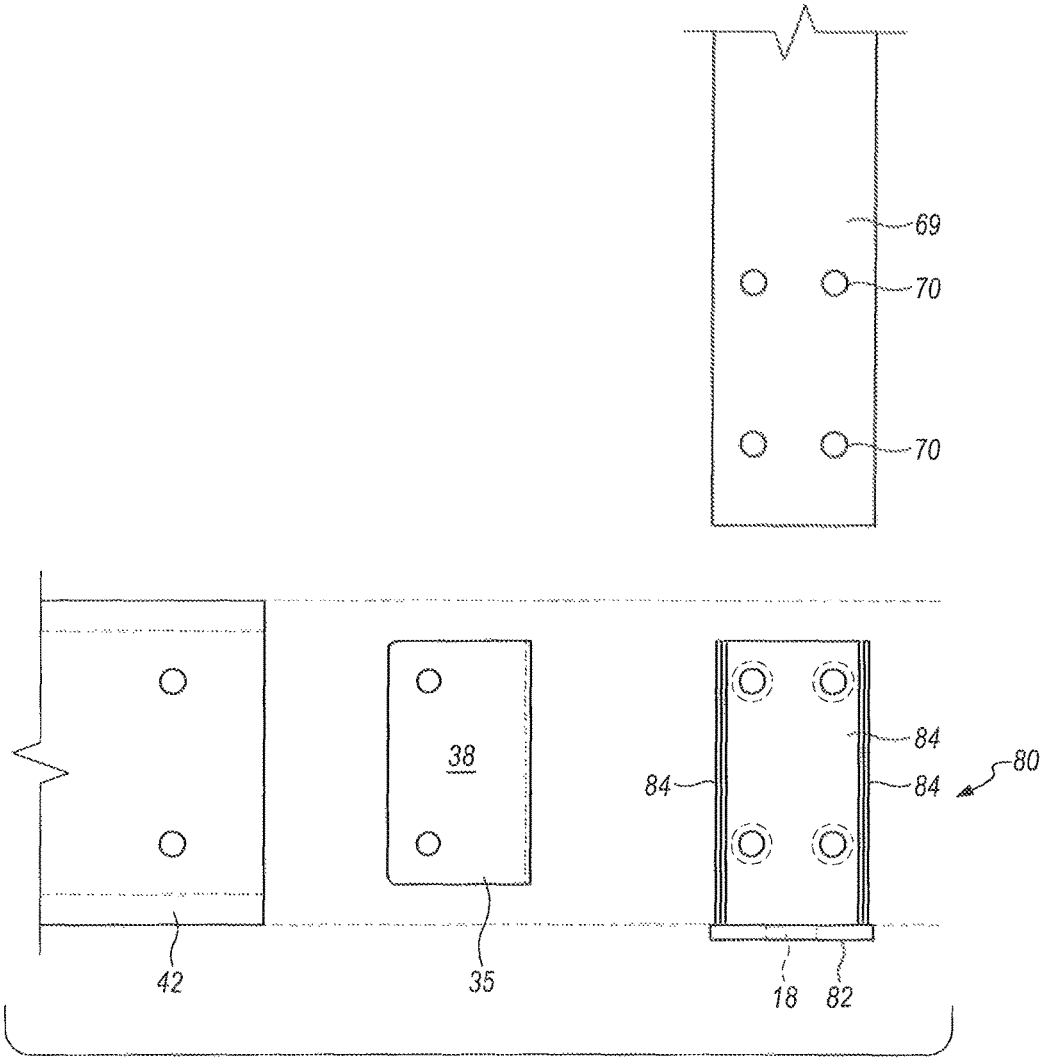
FIG. 5A is an exploded elevational view of a typical end beam connection to an L-bracket and an additional embodiment of a base hub with a vertical post to be installed on the hub.

Referring now to FIG. 5A, an additional base hub configuration is disclosed to provide additional stiffening of the braced steel framework, which is required in regions subject to strong earthquakes and strong hurricanes. The additional hub 80 of FIG. 5A allows shear panels to be attached to the framework. This hub is formed of a base plate 82 and four steel plates 84 welded to the base plate which includes a hole 18 for a foundation anchor. The plates 84 are dimensioned to fit directly into the lower end of a vertical post 69 which has four or more bolt holes 70 formed therein. This arrangement eliminates the prior sleeve 12 that had the bolted attachment to the post through the bolt holes 36 centered on the post. By arranging the four bolt holes 70 in this manner, not only can the beams still be connected to the post as shown in FIGS. 3A-3X, but it is also possible to secure a shear panel in place, as well as a steel channel for an exterior wall assembly, as described below with respect to FIGS. 6, 7 and 8.

Another important aspect of this new approach is that the post is hollow and has interior dimensions which allow it to slide over the hub. The wall thicknesses, for both the hub (the four vertical plates) and the post can be made thicker, as required to support, say, multiple stories, and again, no prior embodiments are compromised in any way.

Figure 5B:
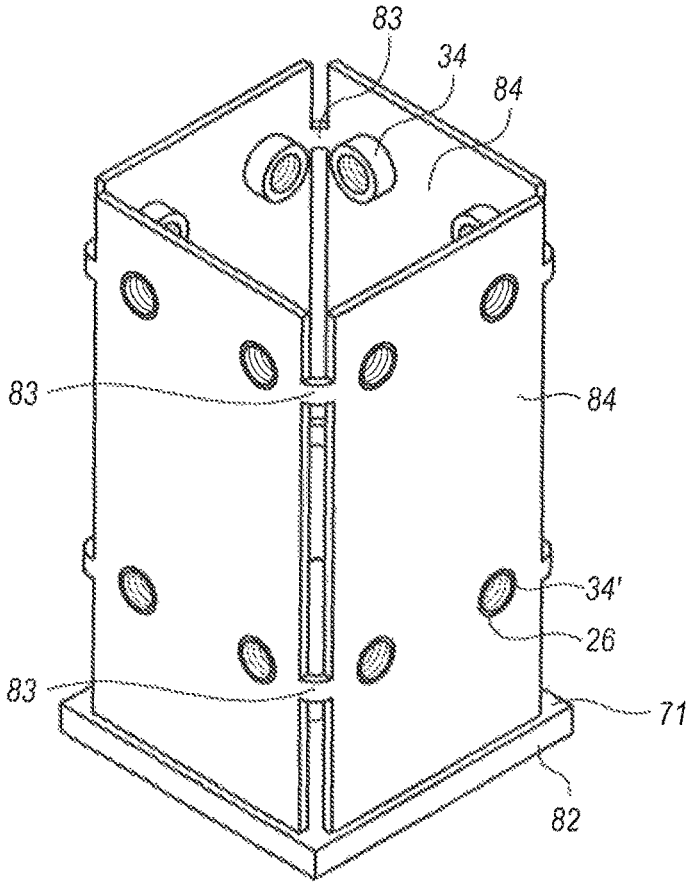
FIG. 5B is a perspective view of a preferred embodiment of the base hub.
Figure 5C:
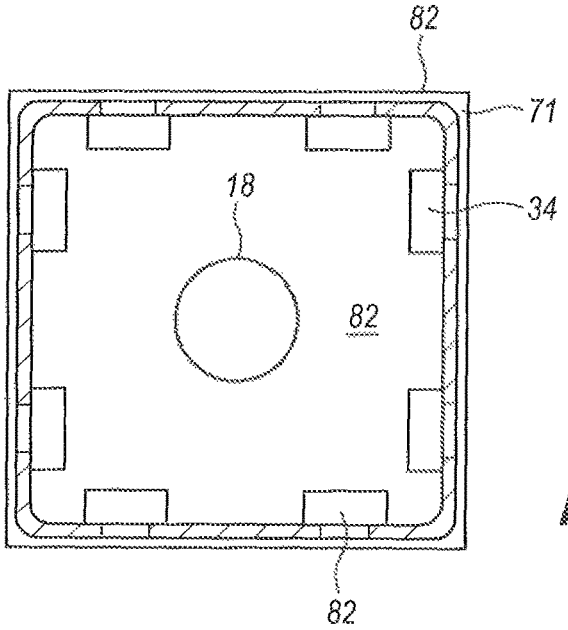
FIG. 5C is a top plan view of the base hub shown in FIG. 5B.

FIGS. 5B and 5C illustrate a preferred embodiment of the base hub 80 of FIG. 5A. In this embodiment the mounting plates 84 are either formed from a single sheet of steel having two connecting points 83 between each plate, or from individual plates welded together at those points which also results in additional stiffness at this connection. The plate structure 84 is welded along its bottom to a base plate 83 to form the lip 71. Also as seen in FIGS. 5B and 5C, the press nuts 34 have cylindrical exterior surfaces 34' and are press fit into bolt holes 26 in the plates.

As in the prior embodiment the plate 82 has an opening 18 in it to receive a foundation anchor. In this case the opening 18 may be formed to be slightly larger than the diameter of the foundation bolts to allow room for proper adjustment and alignment of the posts before the hub is bolted tight to the foundation.

FIG. 6 illustrates a section of the framework of the present invention in use with a shear panel installed at a corner of a building. Shear panels, as noted above, are structural elements, or braced panels, used to resist the effects of lateral loads on the vertical surfaces of the structures due to wind or seismic loads.

Multiple identical shear panels would be required in most framework applications.

Figure 6A:
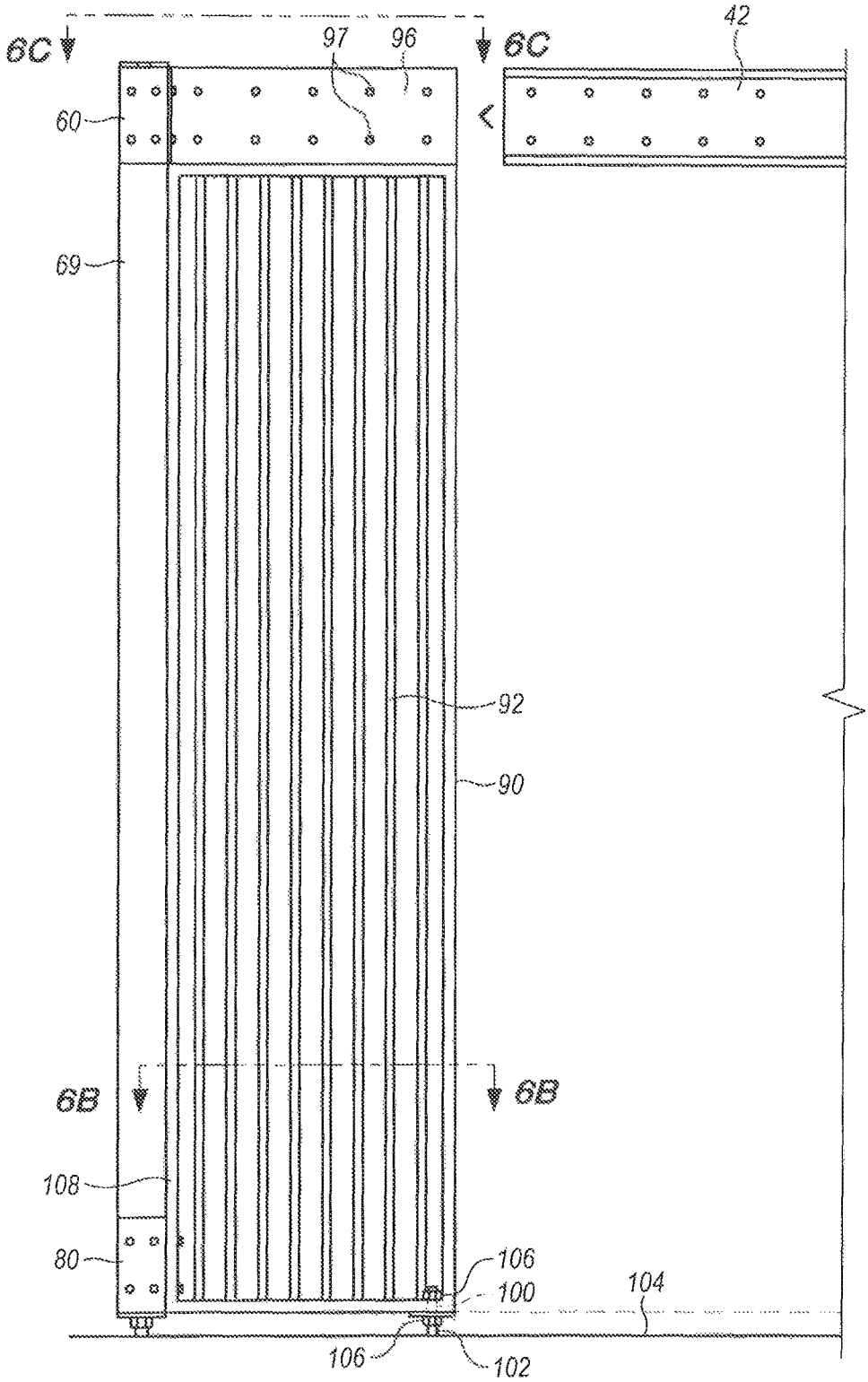
FIG. 6A is an exploded elevational view of a shear wall panel mounted to a post and a typical end beam.
Figure 6B:
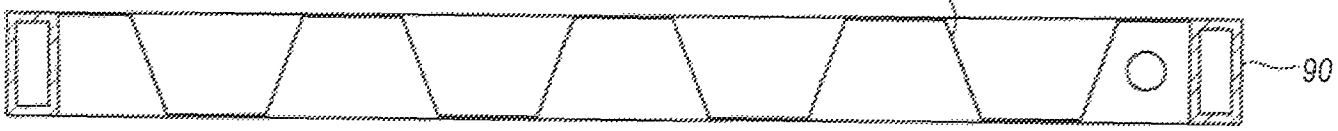
FIG. 6B is a cross-sectional view of the shear panel taken along line 6B-6B of FIG. 6A.
Figure 6C:
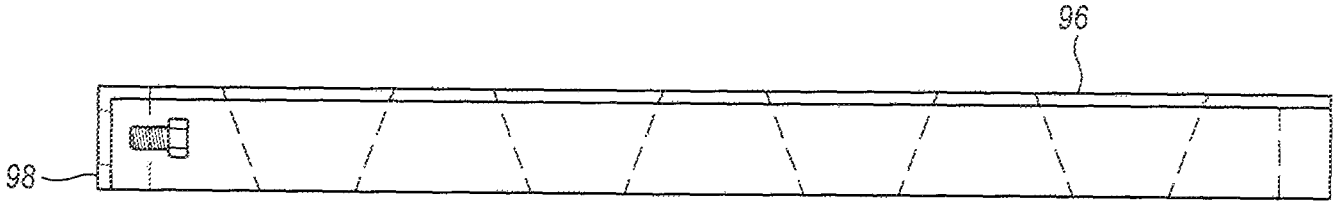
FIG. 6C is a top view of the shear panel along line 6C-6C of FIG. 6A.

The shear panel design shown in FIGS. 6A-6C is similar to ones in use today, in that it consists of a metal peripheral frame 90 surrounding a structural panel 92, in this case corrugated metal as shown.

According to the present invention however the shear panel has a metal/steel plate 96 secured or welded to the top of the frame. That frame (see FIG. 6C) has a lip 98 which abuts a vertical corner post 69 of the frame work and is bolted to the post and terminal hub 60. Plate 96 has multiple bolt holes 97 formed therein which align with bolt holes formed in an end beam 42 and allows them to be bolted together as an integral braced structure.

The bottom of the shear plate has a bolt hole 100 that is adapted to receive a foundation bolt 102 secured in foundation 104 by use of nuts 106. In addition the side 108 of frame 90 can be bolted into the bottom of the post and the alternative base hub 80 of FIG. 5.

Figure 7A:
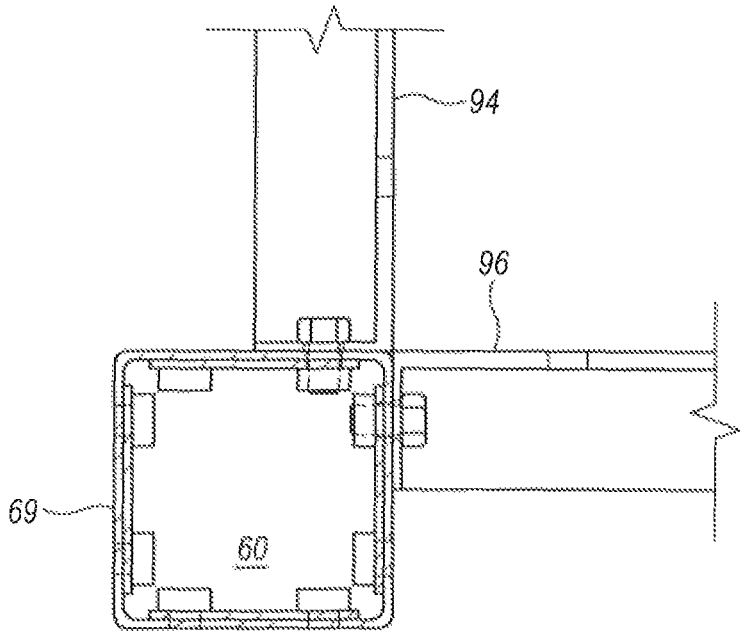
FIGS. 7A-7D are a series of plan sectional views showing the steps of assembling typical end and tie beams, and wall panels at a hub, whether a base hub, top hub or intermediate hub.
Figure 7B:
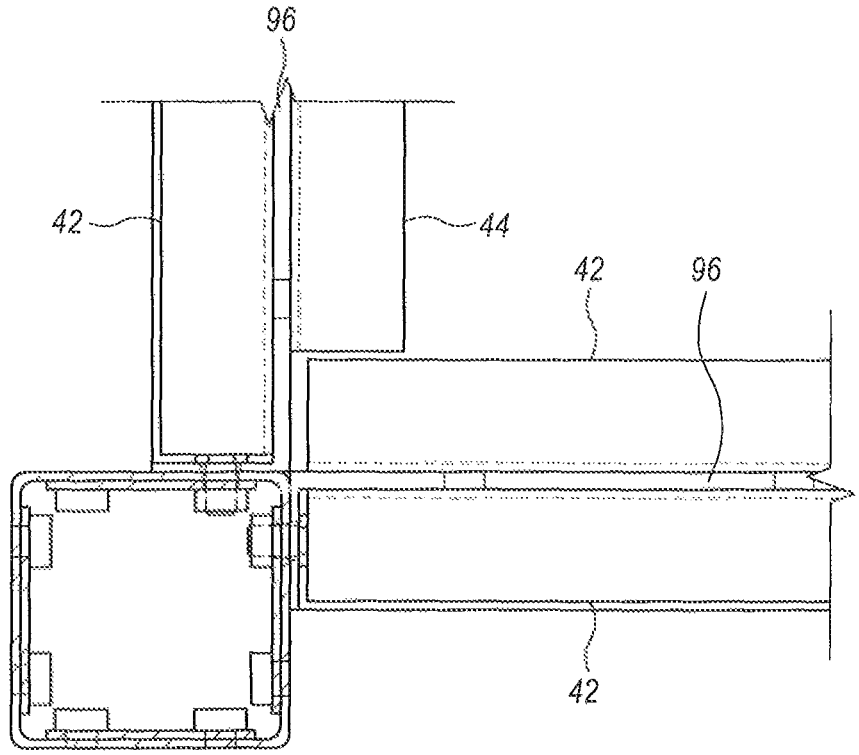

FIGS. 7A-7D illustrate a sequence of four steps, in plan view, which are performed to secure the shear panels at a corner post and then sheath the building with an exterior wall finish. FIG. 7A shows the top 68 of the post 69 with the terminal hub 60 installed. As described above the shear panels 90 are installed and secured top and bottom to the post by bolts (FIG. 7A). Next the support beams 42, 44 are bolted to the shear panels. In a corner as illustrated in FIG. 7B, one of the beams would be an end beam 42 and the beam perpendicular to it is a tie beam 44. If desired, as also shown in FIG. 7B two end beams may be bolted back to back on the shear panel plate 96.

Figure 7C:
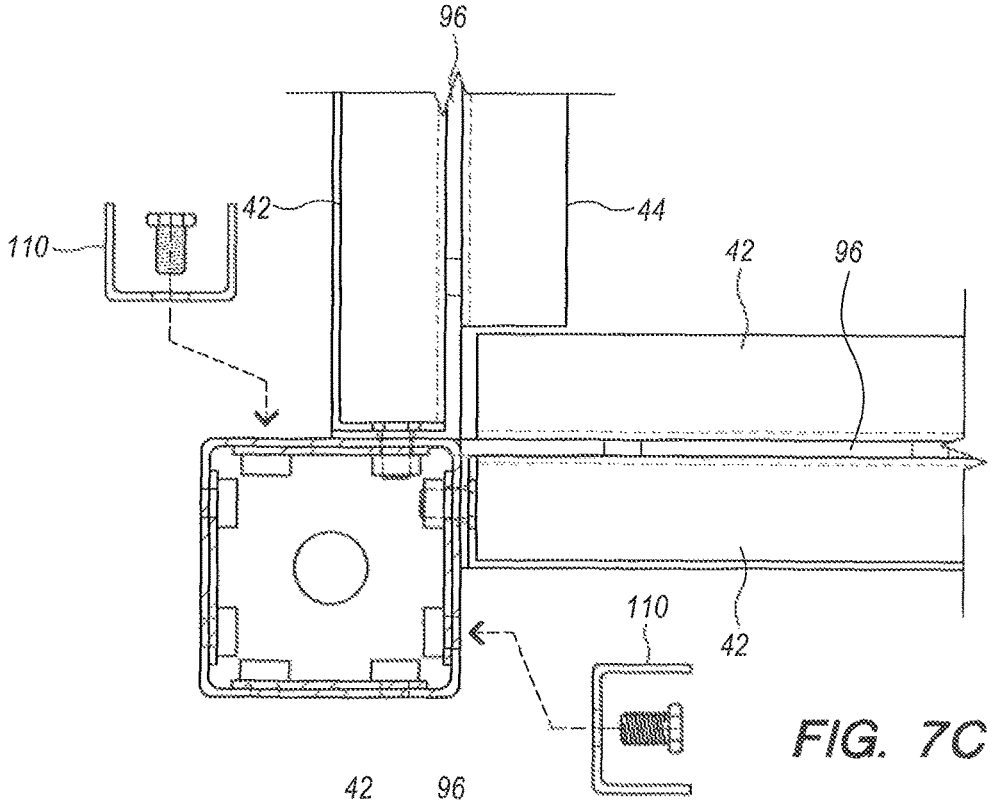

After the shear panels and beams are secured U-shaped exterior wall channels 110 are bolted to the same sides of the post as the shear panels in the space remaining as shown in FIG. 7C.

Figure 7D:
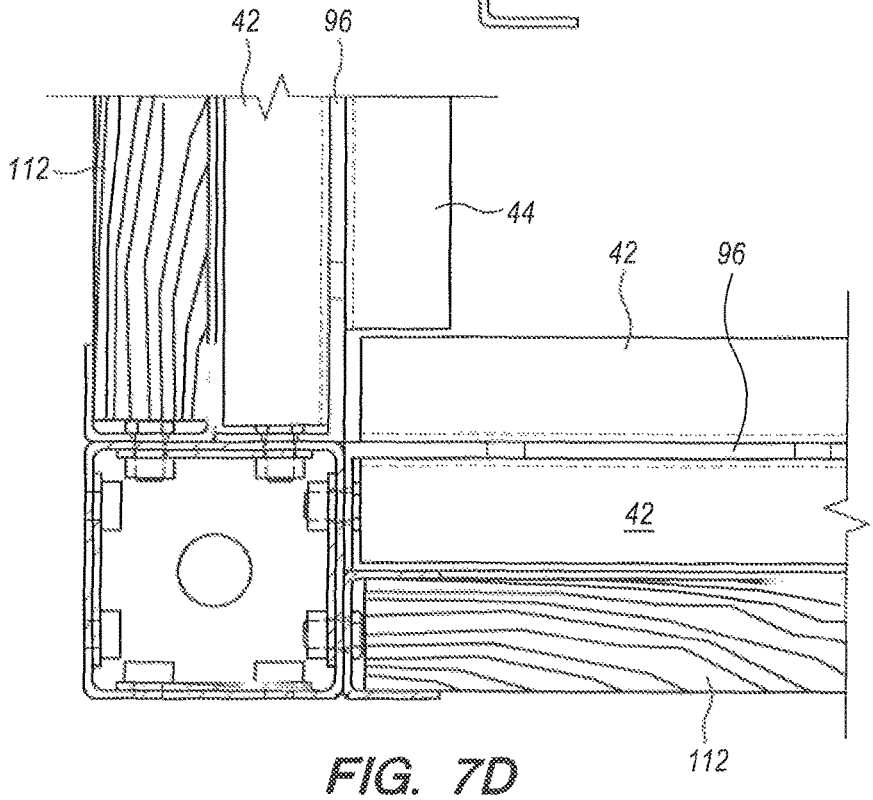

The purpose of the exterior wall channels 110 are to allow "boards" 112 to be dropped in place from the top of the framed wall to enclose the structure (FIG. 7D). These "boards" could be made of many materials: wood, cement, metal sheathed foam boards, etc.

Figure 8:
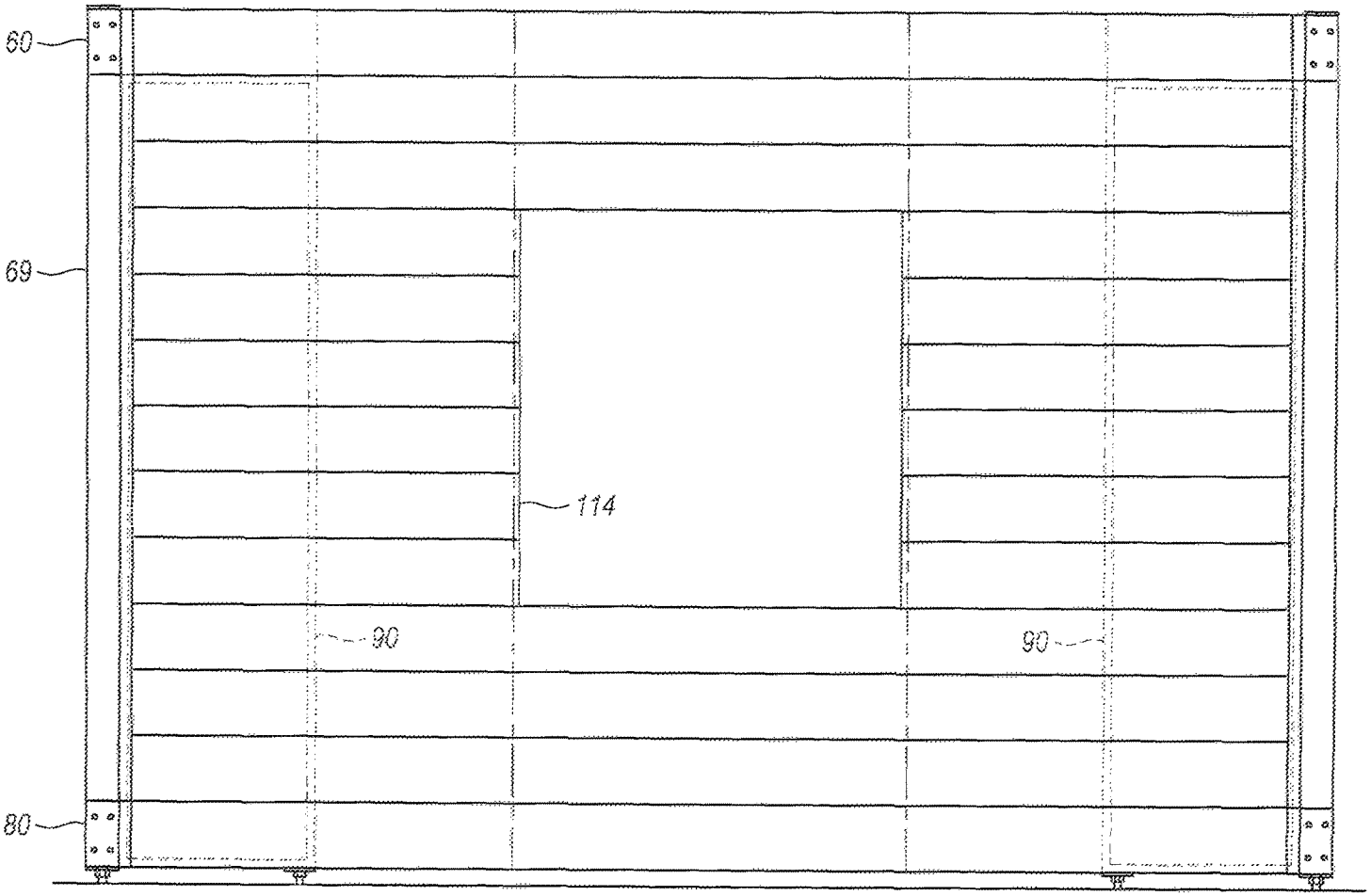
FIG. 8 is an elevational view of an assembled wall according to the invention.

FIG. 8 is an elevation view of a typical 12 foot wide building bay with all major components in place (not shown is required blocking on either side of the window opening 114, which would occur at the interior). This illustration shows the framework positioned on a concrete slab 104. Since the system is post-and-beam, or post- and pier, the framework can readily be assembled with the floor elevated above the ground. This would be important in areas prone to flooding. Although the illustrated embodiment is described as having panels of 12 feet in length, the panels can be provided in other dimensions such as 4 or 6 feet and the like. However, it is preferred that the panels for any building have uniformity of dimensions which provides for dimensional modularity and enhances the ease of assembly and construction.

Figure 9:
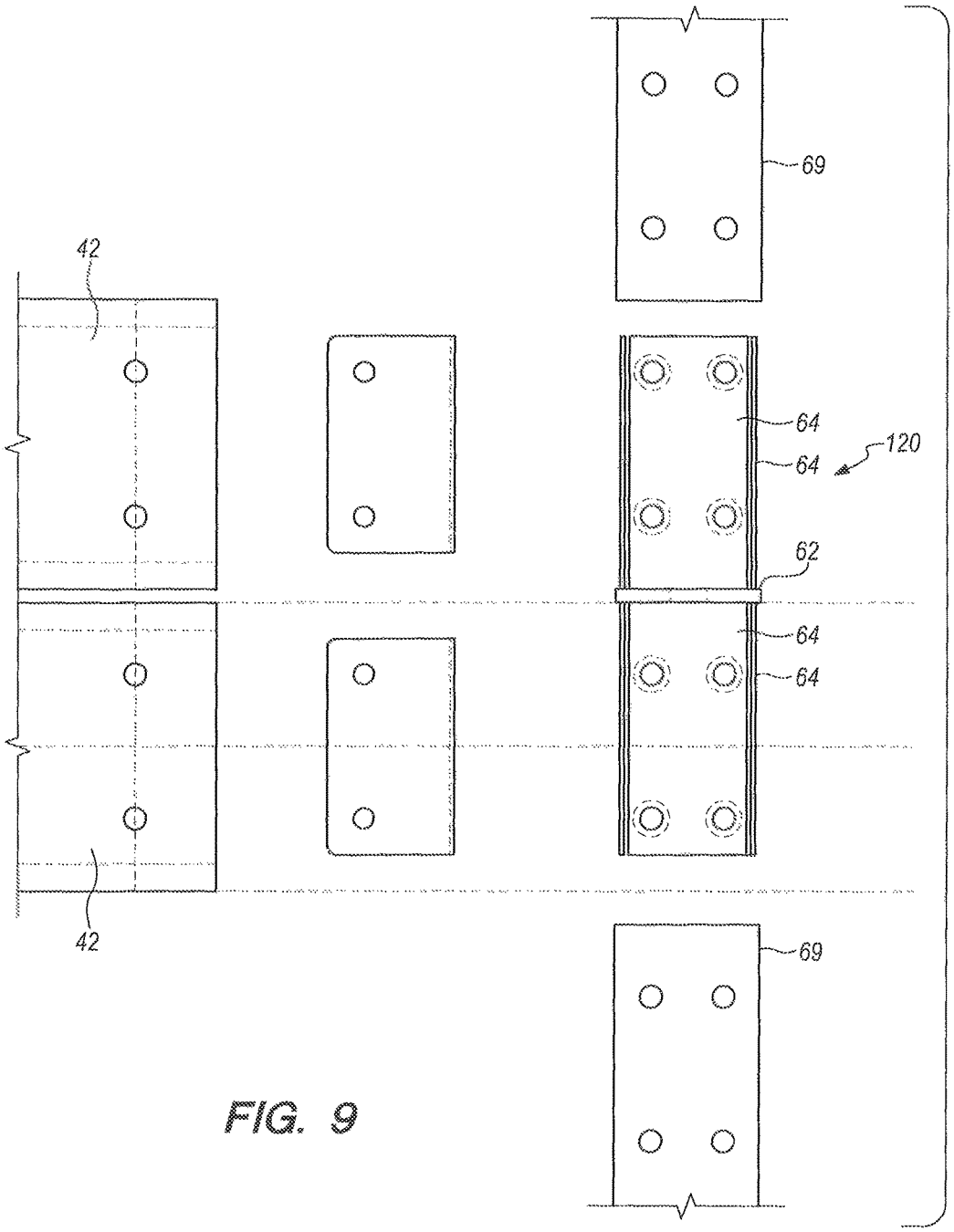
FIG. 9 is an exploded elevational view of an intermediate hub connection to upper and lower posts, a bracket and beam.

Finally, in the event that a multi-story building is required, an intermediate elevation hub for a second story structure is also provided. The intermediate hub 120 is shown in FIG. 9 and is of essentially the same construction as the terminal hub 60 described above, having a base plate 62 and four plates 64 with bolt holes 30. However it has additional plates (four) 64 on the opposite side of plate 62 so it can be inserted in the top of one post 69 and the bottom of another so that a second story can be added.

Although FIG. 9 shows beams 42 connected to both the top and bottom half of the terminal hub 120, in most connections the beams connected to the upper half only are used. In that case a terminal hub can be used whose lower legs are shorter and have only two bolt holes in them corresponding to the two holes shown in FIG. 9 directly below plate 62. Also the plate 62 may be solid or may be formed with a hole 18 to allow passage of utility wiring or piping.

In engineering parlance, the system of this invention is a "braced steel frame". Prior to the present invention, such frames have used wall panels made of framing lumber and plywood to brace the frame. That approach required a significant amount of time and know how to achieve adequate bracing, as well as additional tools. It is important to note that with the addition of a steel shear panel, the entire framework can be assembled using one human-powered tool, a combination spud wrench and ratchet, and with one type of fastener, a ½ inch diameter machine bolt. This is critical, of course, where access to electricity is sparse (or in many places non-existent, as in much of Haiti) and fasteners, except perhaps nails, largely unavailable.

With the addition of the shear panel illustrated here the framework is adequately braced when assembly of the steel framework is completed, allowing do-it-yourselfers to install many kinds of enclosure means, and other items, to finish off the building over time, or when funds become available (typically done in poor regions). A completed framework could even be covered temporarily with tarps (for privacy).

A demonstrably safe structure, resistant to extreme natural forces, that can be constructed by unskilled people, is unprecedented.

Although the invention has been described in connection with the illustrative embodiments, it will be understood by those skilled in the art that the invention is not limited to those precise embodiments but that various changes and modifications may be effected therein without departing from the scope or spirit of the invention.

What is claimed is:

1. An orthogonal frame-work system comprising:

a plurality of hollow vertical columns of predetermined cross sectional configuration, having open top and bottom ends;

a plurality of C-shaped beams each having an elongated web and a pair of facing elongated channels on opposite sides of the web and including a plurality of bolt holes formed in the elongated web of the beam;

a plurality of beam/column hubs each having a plurality of mounting plates extending from said hub, dimensioned and arranged to be received in one end of a vertical column;

said mounting plates and said columns each having a plurality of bolt holes formed therein arranged such that the bolt holes in the mounting plates are in axial alignment with the bolt holes in said columns when a hub's mounting plates are inserted in a vertical column end;

a plurality of L-shaped brackets each having a long leg and a short leg, said legs having a plurality of bolt holes formed therein, the bolt holes in the long legs of the brackets being dimensioned and arranged to align with at least some of the bolt holes in the elongated web of one of said beams and the bolt holes in said short legs being dimensioned and arranged to align with at least some of the bolt holes in said mounting plates when the hub mounting plates are inserted in one of said vertical columns;

a plurality of bolt nuts secured to said mounting plates in alignment with the bolt holes in the mounting plates; and a plurality of bolts to bolt the beams, brackets and hubs together through their respective aligned bolt holes.

2. The system as defined in claim 1 wherein said plurality of hubs include base hubs and terminal hubs each of which have a plurality of mounting plates;

wherein the mounting plates of the base hubs are secured to the base hubs in position to form a lip along the periphery of the hub whereby the lip of the hub engages the bottom end of a post placed on the base hub.

3. The system as defined in claim 2 wherein the mounting plates of said terminal hubs are secured to the terminal hubs in a position to form a lip along the periphery of the terminal hub whereby the lip of the hub engages the top edge of a post in which the terminal hub is inserted.

4. The system as defined in claim 3 wherein said plurality of hubs include intermediate hubs for connecting two vertical columns together end to end, and the mounting plates of said intermediate hubs are secured to intermediate hub in a position to form a lip along the periphery of the mounting plates to engage the ends of the vertical columns into which they are inserted.

5. The systems as defined in claim 4 wherein the bolt holes in said elongated webs of the beams are arranged so that the bolt holes of two beams align with one another when placed with their elongated webs back to back.

6. The system as defined in claim 5 including exterior wall mounting channels comprising U-shaped channels having bolt holes formed therein to align with the bolt holes in said mounting plates on the hubs whereby the exterior wall mounting channels can be mounted to spaced vertical columns facing each other, whereby exterior finish boards and panels may be inserted and supported therein.

7. The system as defined in claims 2 or 6 wherein said base hubs have means formed therein for receiving foundation bolts to secure the base hubs to a foundation.

8. The system as defined in claim 1 wherein said L-brackets and their respective bolt holes on the short leg are located to align with the bolt holes on the hub mounting plates when the brackets are connected with their long legs back to back and when the brackets are attached in a reverse position when their long legs are spaced from each other.

9. The system as defined in claim 1, including shear panels having a peripheral frame including top and bottom edges, a stress resisting panel in the frame and a rigid plate secured to the top edge of the frame, said frame having a first set of bolt holes formed therein to align with the bolt holes in the mounting plates of the hubs thereby to be secured to a vertical column by said bolts and said rigid plate also having a second set of bolt holes formed therein to align with the bolt holes in said beam's elongated webs whereby the shear panel may be rigidly connected to the beams.

10. The system as defined in claim 1 wherein said hubs include base hubs and said base hubs include an outer sleeve having the same predetermined cross section as said hollow vertical columns, said outer sleeve having an upper end and said mounting plates extending beyond the upper end of said sleeve with the bolt holes in the mounting plates also above said upper edge of the sleeve whereby when a vertical column is placed on the base hub it receives the mounting plates within its hollow cross section to align the bolt holes in the mounting plates with the bolt holes in the vertical column.

11. A system as defined in claim 1 including wherein said vertical columns are hollow square posts.

* * * * *